US007347704B2

(12) United States Patent
Tsuji

(10) Patent No.: US 7,347,704 B2
(45) Date of Patent: Mar. 25, 2008

(54) CONNECTOR

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/712,870

(22) Filed: Mar. 1, 2007

(65) Prior Publication Data

US 2007/0207646 A1 Sep. 6, 2007

(30) Foreign Application Priority Data

Mar. 1, 2006 (JP) ..... 2006-055150
Mar. 1, 2006 (JP) ..... 2006-055151

(51) Int. Cl.
*H01R 13/62* (2006.01)

(52) U.S. Cl. ..... 439/159; 439/157; 439/341; 439/376

(58) Field of Classification Search ..... 439/157, 439/341–342, 376, 159
See application file for complete search history.

(56) References Cited

U.S. PATENT DOCUMENTS 5,681,175 A 10/1997 Busse et al.
5,888,080 A 3/1999 Maejima
5,902,141 A * 5/1999 Iwahori ..... 439/157
6,017,236 A 1/2000 Yoshida et al.
6,142,826 A * 11/2000 Bourillon ..... 439/595
6,149,473 A 11/2000 Lalange et al.
6,183,276 B1 * 2/2001 Tsuji et al. ..... 439/157
6,382,992 B1 5/2002 Bouchan et al.
6,422,882 B1 7/2002 May et al.
7,011,536 B2 * 3/2006 Okamoto et al. ..... 439/157
2006/0009057 A1 1/2006 Winkler et al.

FOREIGN PATENT DOCUMENTS

JP 6-5148 1/1994
JP 2003-151682 5/2003
WO WO 97/07567 2/1997

* cited by examiner

*Primary Examiner*—Truc Nguyen
(74) *Attorney, Agent, or Firm*—Gerald E. Hespos; Anthony J. Casella

(57) ABSTRACT

A connector has a housing (10) and a slider (30). The slider (30) has a cam plate (31) that can be inserted into an accommodation space (S) of the housing (10). At least one lock (32, 38) is formed in the cam plate (31). A hole (54) is formed on a rear surface of the housing (10) and communicates with the accommodation space (S). A to-be-locked portion (53) is formed in the accommodation space (S) for engaging the lock (32, 38) to hold the slider (30) at either of a wait position and a fit-in position in the accommodation space (S). The to-be-locked portion (53) can be formed via the hole (54) to enable a simple construction for a molding die, to provide good molding efficiency, and to make cost low.

14 Claims, 25 Drawing Sheets

CONNECTOR

BACKGROUND OF THE INVENTION

1. Field of the Invention

The invention relates to a connector.

2. Description of the Related Art

Japanese Patent Application Laid-Open No. 6-5148 discloses a connector with a housing and a slider that has two cam plates accommodated on the housing. A locking projection is formed at a widthwise end of the cam plate for holding the cam plate at a predetermined position in the housing.

The flexible space for the locking projection of the cam plate shown in Japanese Patent Application Laid-Open No. 6-5148 is in the vicinity of the edge of the cam plate. Thus, the strength of the peripheral portion of the cam plate might be insufficient.

A demand exists for a smaller connector. A flexible space could be formed within the thickness range of the cam plate, and the locking projection could be made to flex in the thickness direction of the cam plate. Thus, the locking projection could remain in the flexible space even when the locking projection flexes to a maximum. The interior of the housing has a to-be-locked portion to be locked to the locking projection and the escape space for preventing the locking projection from keeping a flexed state while the slider is being operated and after the operation finishes.

In the above-described construction, it is necessary to provide the housing-shaping die with the to-be-locked portion and the escape space. A die with these features is very complicated and provides a small number of products.

The invention has been completed In view of the above-described situation. Therefore it is object of the invention to ensure sufficient strength for the peripheral portion of the cam plate. It is also an object of the invention to provide sufficient strength for the cam plate near the lock and near the flexible space for the lock. It is another object of the invention to simplify the construction of a die to make the manufacturing cost low.

SUMMARY OF THE INVENTION

The invention relates to a connector with first and second housings that can fit together. The first housing has at least one accommodation space that opens in a direction orthogonal to a fit-in direction of the housings. The connector also has a slider with at least one cam plate that can be accommodated inside the accommodation space. A cam groove is formed in the cam plate of the slider and can engage a cam pin on the second housing. The slider is inserted into the accommodation space and pulls the housings together due to a cam operation caused by engagement between a follower pin on the second housing and a cam groove in the slider. The cam plate has opposite first and second parallel surfaces that extend along the fit-in direction of the slider into the housing. At least one lock is formed on the cam plate and projects parallel to the surfaces of the cam plate and along the fit-in direction of the slider. The lock can elastically deform in a direction from the first surface of the cam plate to the second surface. The accommodation space of the first housing has a receiving surface for receiving the first surface of the respective cam plate. A to-be-locked portion is formed on the receiving surface and is configured to engage the lock of the cam plate for holding the slider at a predetermined position. An escape space is provided for preventing the lock and the receiving surface from interfering with each other in an insertion direction of the slider.

A peripheral wall that defines the escape space is formed over an entire periphery of the escape space by cutting or moving a die for shaping the escape space from an inner side of the cam plate to an outer side thereof. Thus, sufficient strength for the cam plate is achieved.

The die for shaping the escape space is cut along the fit-in direction of both housings. Thus, a hole is formed in a wall of the female housing that extends orthogonal to the fit-in direction of both housings. Accordingly, it is possible to use a slide die having only two cutting or moving directions. As a result, the die is structural simpler and less costly.

The slider is movable between a wait position where the follower pin can be received at the entrance of the cam groove and a fit-in position where the housings are fit together. Additionally, the slider preferably can be held at the wait position and at the fit-in position. Therefore it is possible to prevent the slider disposed at the wait position from accidentally moving to the fit-in position and it is possible to prevent the slider disposed at the fit-in position from moving to the wait position.

The accommodation space preferably penetrates through the first housing in a widthwise direction so that the slider can be inserted selectively into the first housing from either side. Therefore the mounting direction of the slider can be selected according to a situation of the job site.

A guide preferably is formed on the cam plate; and a guide receiving portion is formed on a wall of the accommodation space. The guide receiving portion matches the guide when the cam plate is in a proper orientation for insertion into the accommodation space and permits insertion of the cam plate. The guide receiving portion does not match the guide when cam plate is inserted into the accommodation space in an improper orientation, thus preventing insertion of the cam plate.

The slider preferably includes two cam plates and an operation portion connecting ends of the cam plates to each other. Thus, the insertion of the slider can be accomplished easily by pressing the operation portion toward the first housing.

Two to-be-locked portions preferably are provided along a moving direction of the slider. The lock engages one to-be-locked portion at the wait position and the other to-be-locked portion at the fit-in position. With this construction, it is necessary to provide the slider with only one lock, thereby by decreasing the number of the portions where a flexible space is required. Accordingly, it is possible to simplify the construction of the slider and to secure the strength of the cam plate.

DETAILED DESCRIPTION OF THE PREFERRED EMBODIMENTS

Figure 1:
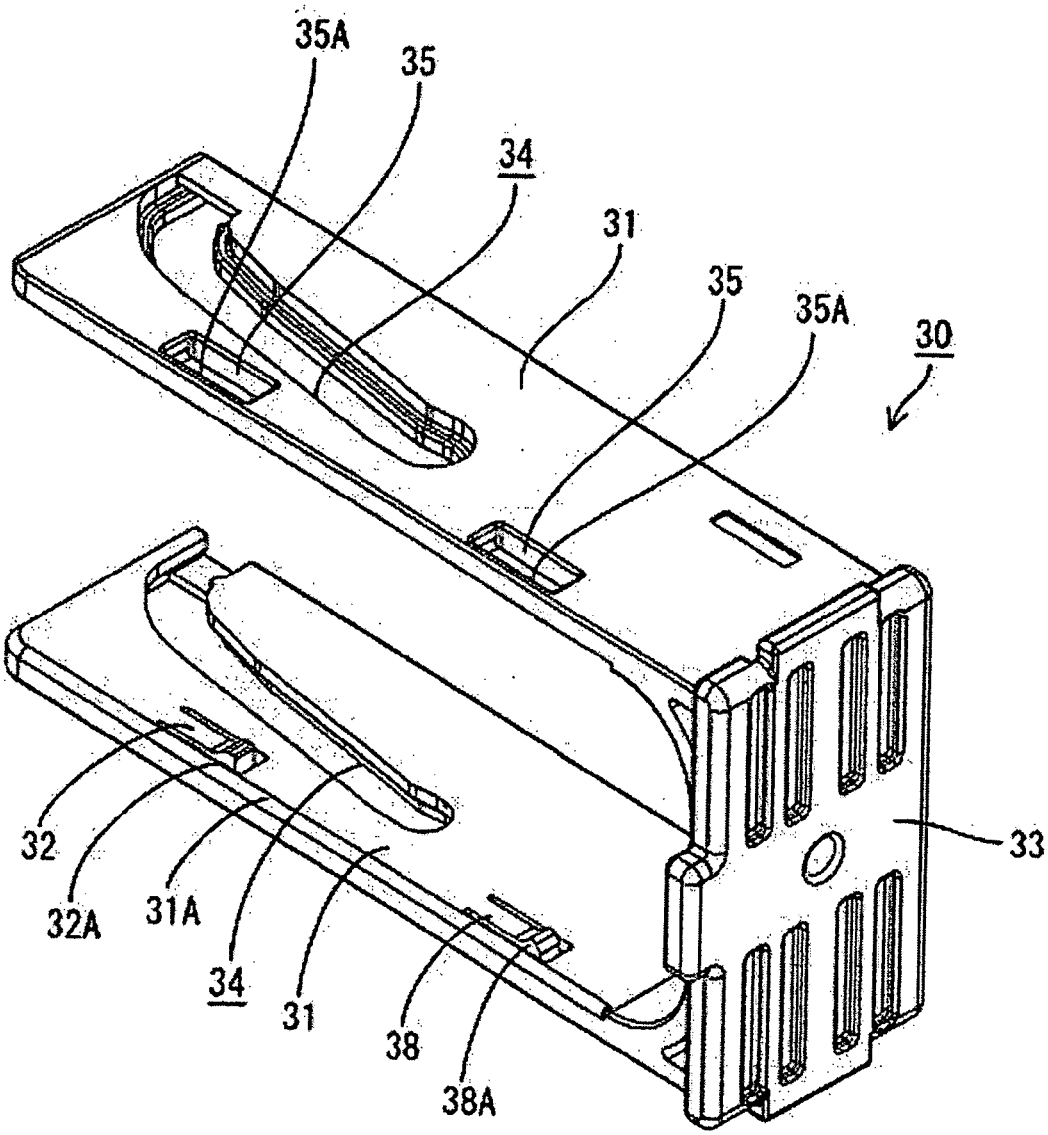
FIG. 1 is a perspective view showing a slider of a first embodiment.

A connector in accordance with a first embodiment of the invention has a female housing 10, a male housing 20, and a slider 30, as illustrated in FIGS. 1 through 20. The housings 10 and 20 are fit together by mounting the slider 30 in a direction orthogonal to a fit-in direction of the housing 10 and 20. In the following description the fit-in surface side of both housings 10, 20 is referred to as the front.

Figure 3:
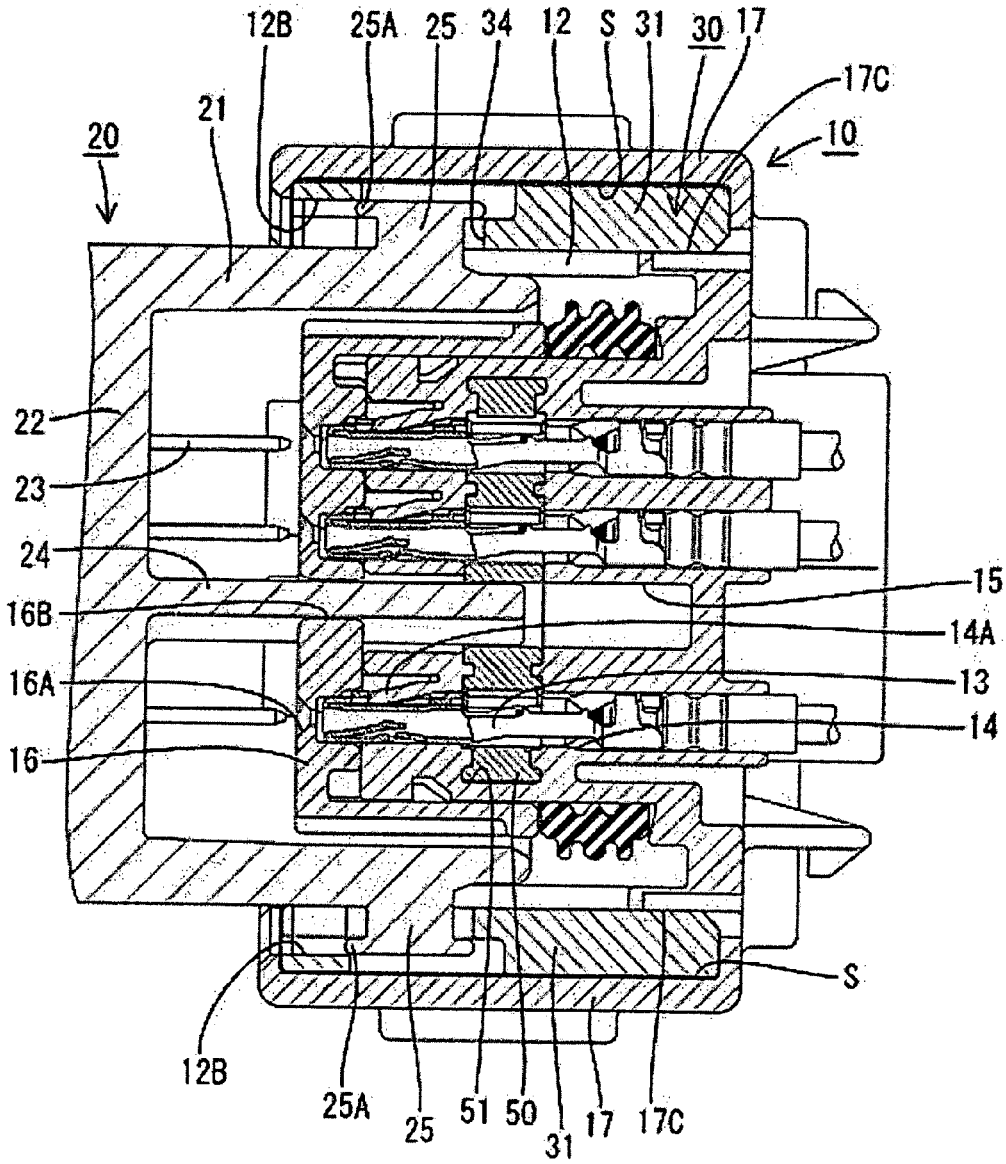
FIG. 3 is a side sectional view showing a state in which an operation of fitting both housings in each other has been started.
Figure 4:
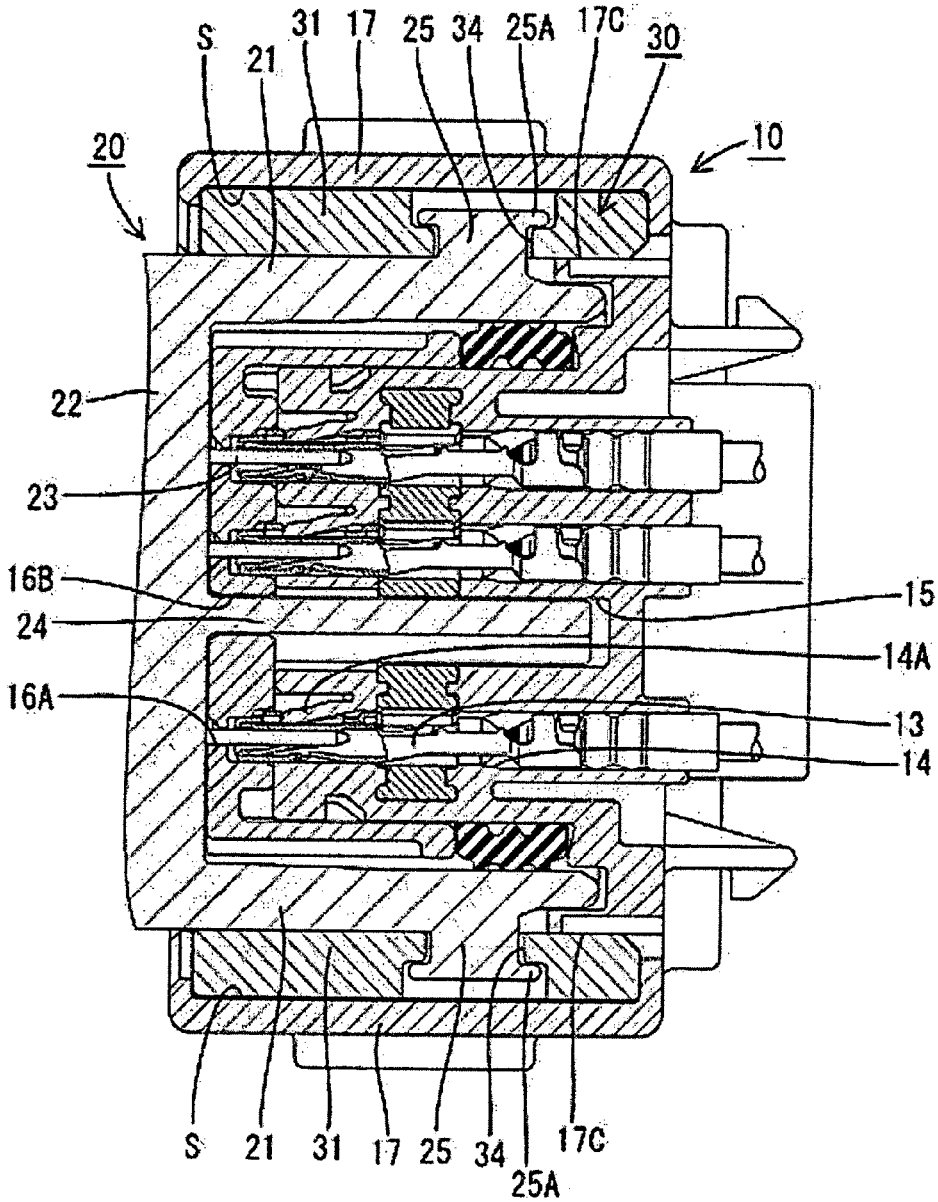
FIG. 4 is a side sectional view showing a state in which the operation of fitting both housings in each other has been completed.

The male housing 20 is made of synthetic resin. As shown in FIG. 3, the male housing 20 has a forwardly open hood 21. The hood 21 has a rear wall 22 and tab-shaped male terminal fittings 23 project forward from the rear wall 22 of the hood 21. A plated-shaped guide 24 also projects forward from the rear wall 22 of the hood 21. Approximately columnar follower pins 25 project out from approximately widthwise center positions of the upper and lower walls of the hood 21. A flange 25A is formed along the entire periphery of a projected end of each follower pin 25.

Figure 13:
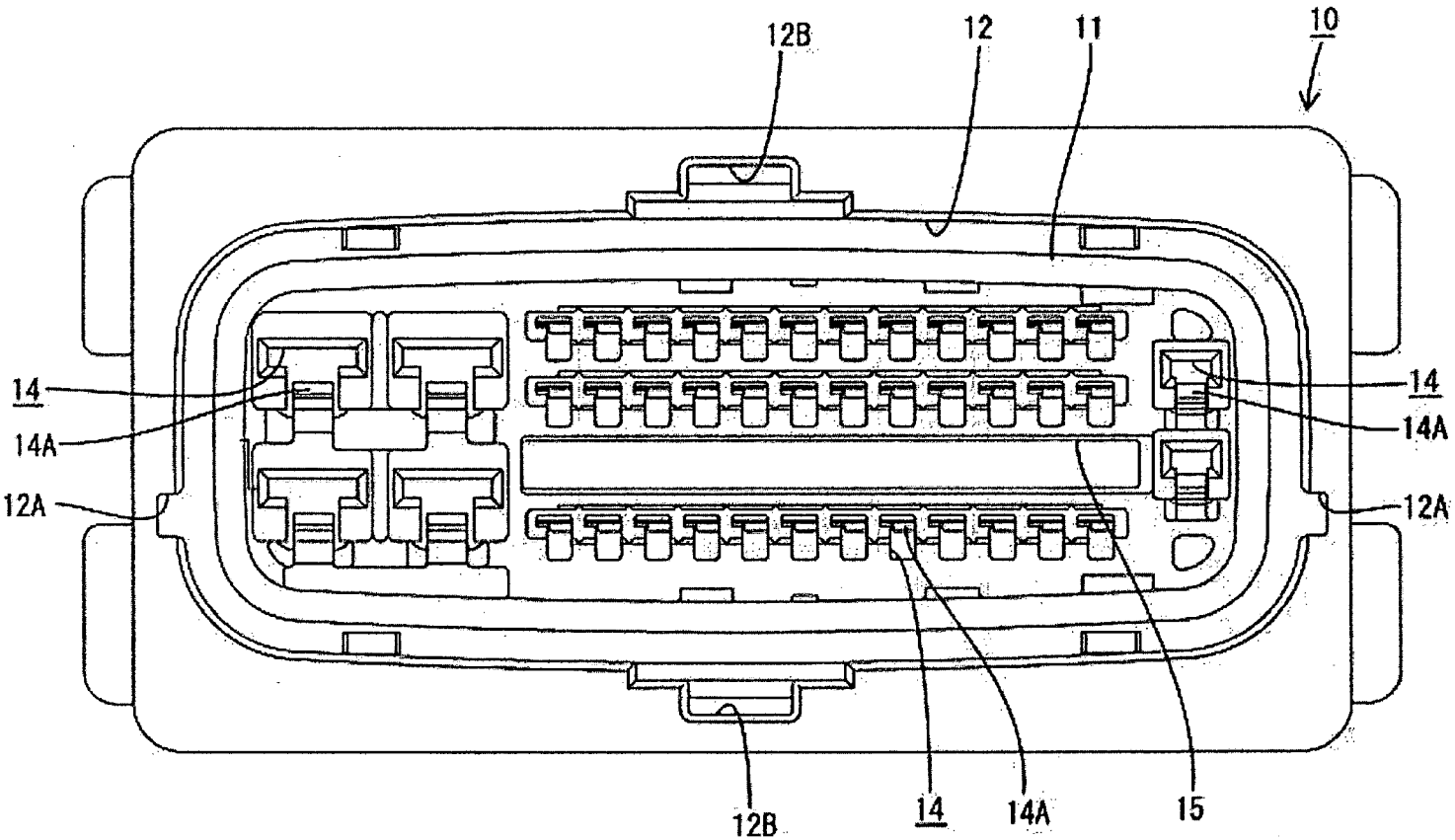
FIG. 13 is a front view showing the female housing.

The female housing 10 also is made of synthetic resin and has an approximately rectangular block shape, as shown in FIG. 13. An approximately block-shaped body 11 is formed inside the female housing 10 and a substantially tubular fit-in portion 12 is formed around the periphery of the body 11. The hood 21 of the male housing 20 is capable of advancing into the space between the body 11 and the fit-in portion 12 as the male housing 20 is fit into the female housing 10. The male terminal fittings 23 fit respectively in female terminal fittings 13 when the male and female housings 20 and 10 are fit together completely. Thus, the male terminal fittings 23 and the female terminal fittings 13 connect conductively with each other.

Figure 2:
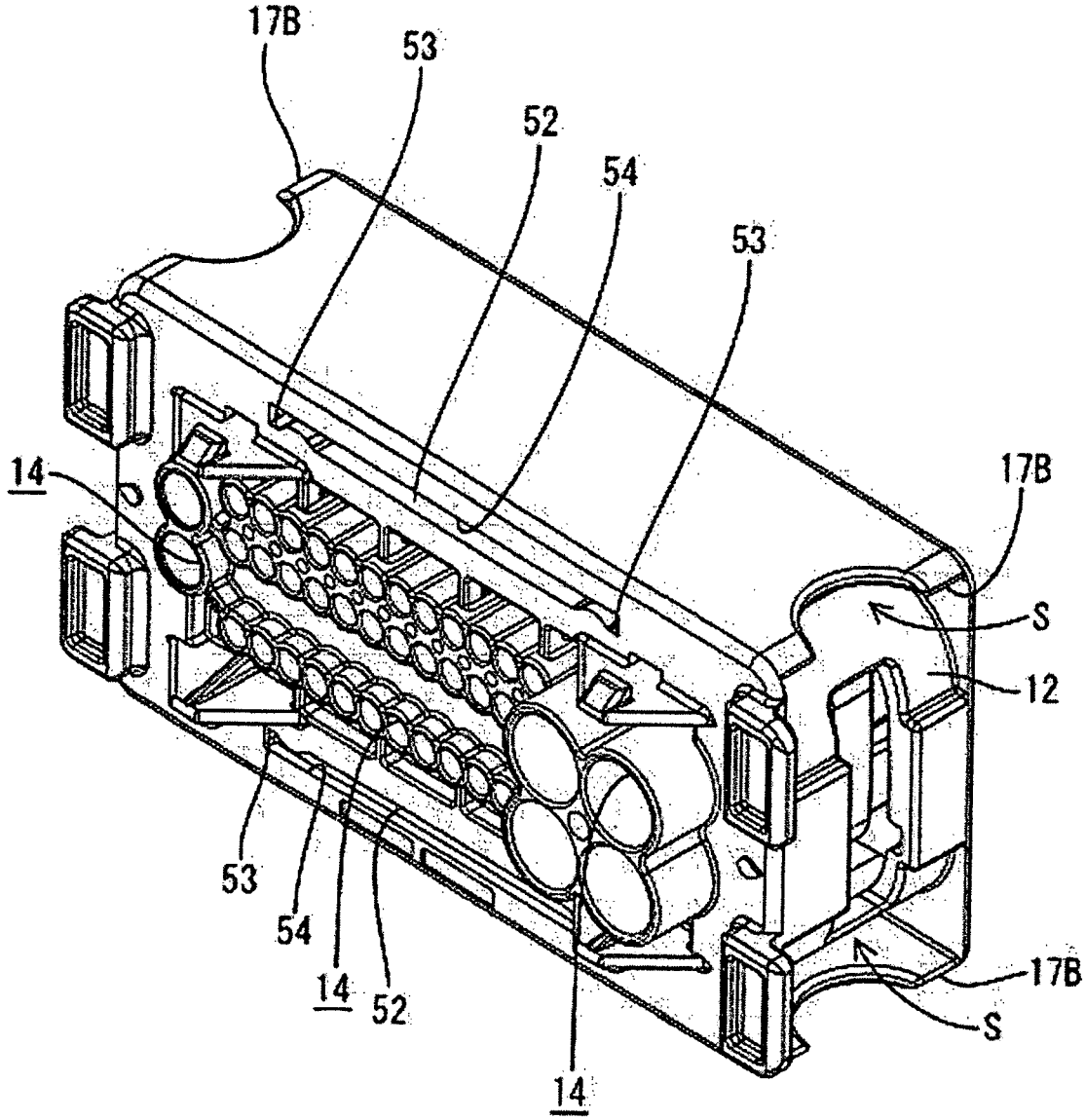
FIG. 2 is a perspective view of a female housing of the first embodiment.

Accommodation spaces S are disposed at upper and lower sides of the fit-in portion 12, as shown in FIG. 2. Each accommodation space S penetrates the female housing 10 in the widthwise direction and the slider 30 can be mounted in the accommodation spaces S of the female housing 10 from either widthwise side. As shown in FIG. 13, two concave guides 12A are formed at lower positions of both widthwise ends of an inner peripheral surface of the fit-in portion 12. An unshown guide projection of the male housing 20 is capable of moving into the concave guide 12A to prevent the housings 10 and 20 from being erroneously fit together.

Three kinds of cavities 14 of different sizes penetrate the body 11 in the longitudinal direction of the female housing 10. As shown in FIG. 3, appropriately dimensioned female terminal fittings 13 can be inserted respectively into the cavities 14 from the rear. Lances 14A are cantilevered forward in the cavities 14 and hold the female terminal fittings 13 that have been inserted to proper positions in the cavities 14. Retainer-accommodating holes 51 penetrate through the female housing 10 at approximately the center of both widthwise side surfaces and accommodate side retainers 50 therein (see FIG. 12). The side retainers 50 cooperate with the lances 14A to lock the female terminal fittings 13 redundantly.

Figure 10:
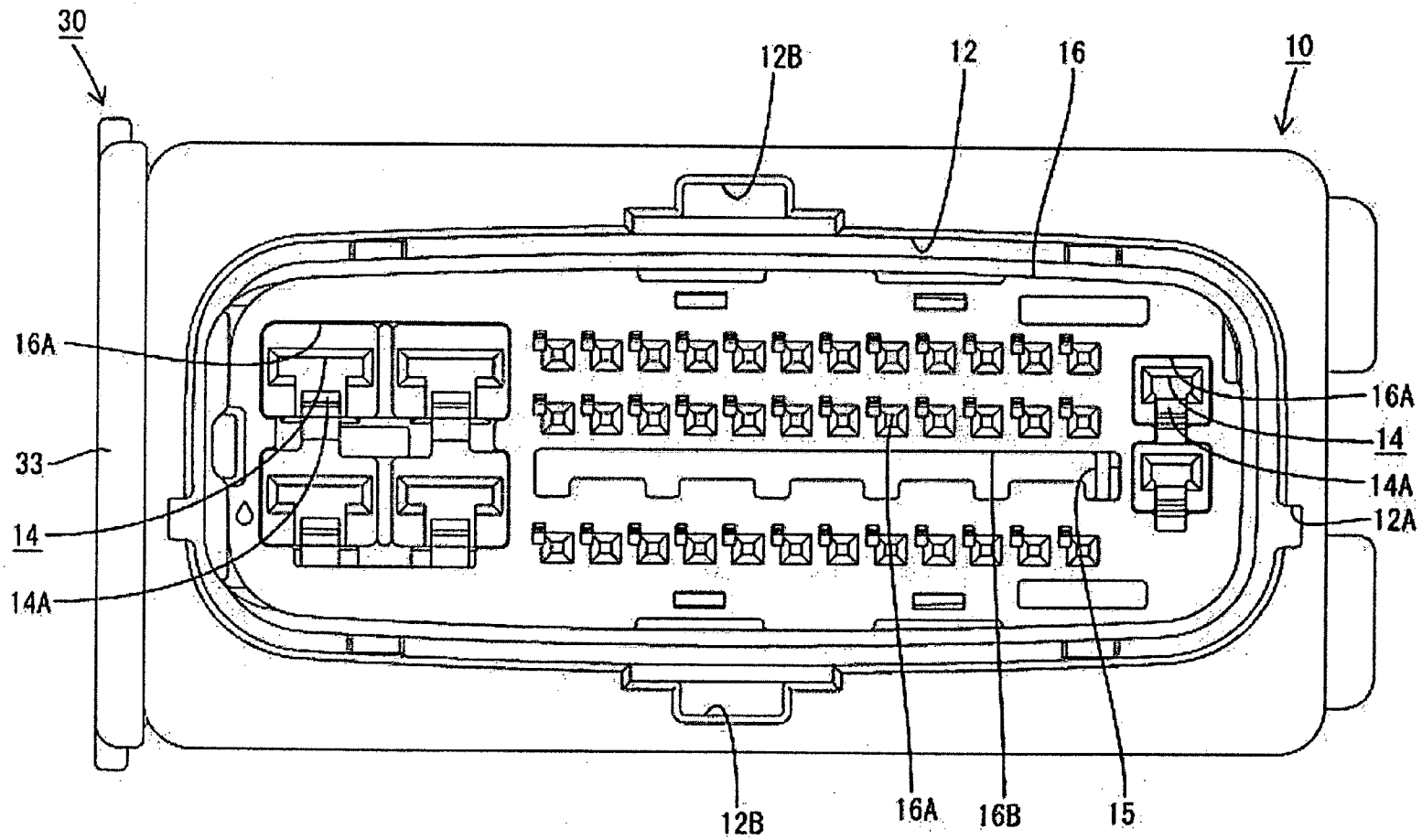
FIG. 10 is a front view showing the state in which the slider is disposed at the fit-in position.
Figure 11:
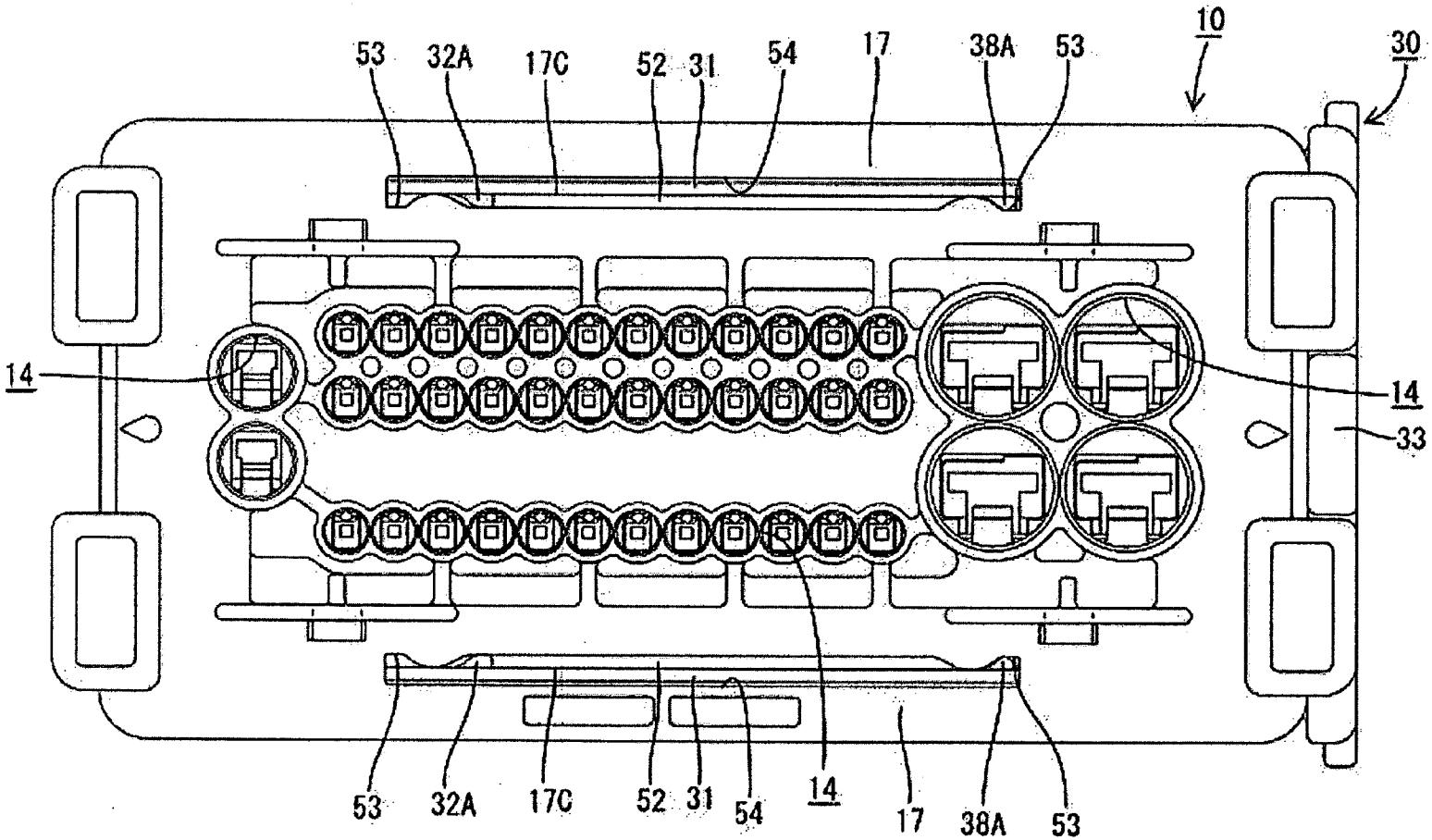
FIG. 11 is a rear view showing the state in which the slider is disposed at the fit-in position.

A wide rectangular fit-in insertion hole 15 is formed on a front surface of the body 11 and the guide piece 24 of the male housing 20 can be accommodated in the fit-in insertion hole 15. As shown in FIG. 10, a front cap 16 can be mounted on the front surface of the body part 11. Through-holes 16A corresponding to the cavities 14 and a through-hole 16B corresponding to the fit-in insertion hole 15 are formed on the front cap 16.

The accommodation space S is defined between the fit-in portion 12 and an outer wall 17. A tapered surface 17A is formed widthwise at a rear corner between of the wall 17 of the accommodation space S and the fit-in portion 12. The tapered surface 17A confronts a chamfer 31A of a cam plate 31 to allow the slider 30 to be inserted into the accommodation space S in a normal posture. However, a front end of the cam plate 31 interferes with an open edge 17B of the accommodation space S when the slider 30 is inverted to prevent the slider 30 from being inserted into the accommodation space S. Thus, the tapered surface 17A prevents the slider 30 from being inserted upside down into the accommodation space S.

An escape groove 12B is formed on a front surface of the female housing 10 at a position corresponding to the follower pin 25 of the male housing 20. As shown in FIG. 13, the escape groove 12B is cut out from the front side of the female housing 10 to the fit-in portion 12 along an advance path of the follower pin 25 and provides communication between the front space of the female housing 10 and the accommodation space S. Thus, the follower pin 25 can penetrate into the accommodation space S through the escape groove 12B when the male housing 20 fits in the female housing 10.

Figure 14:
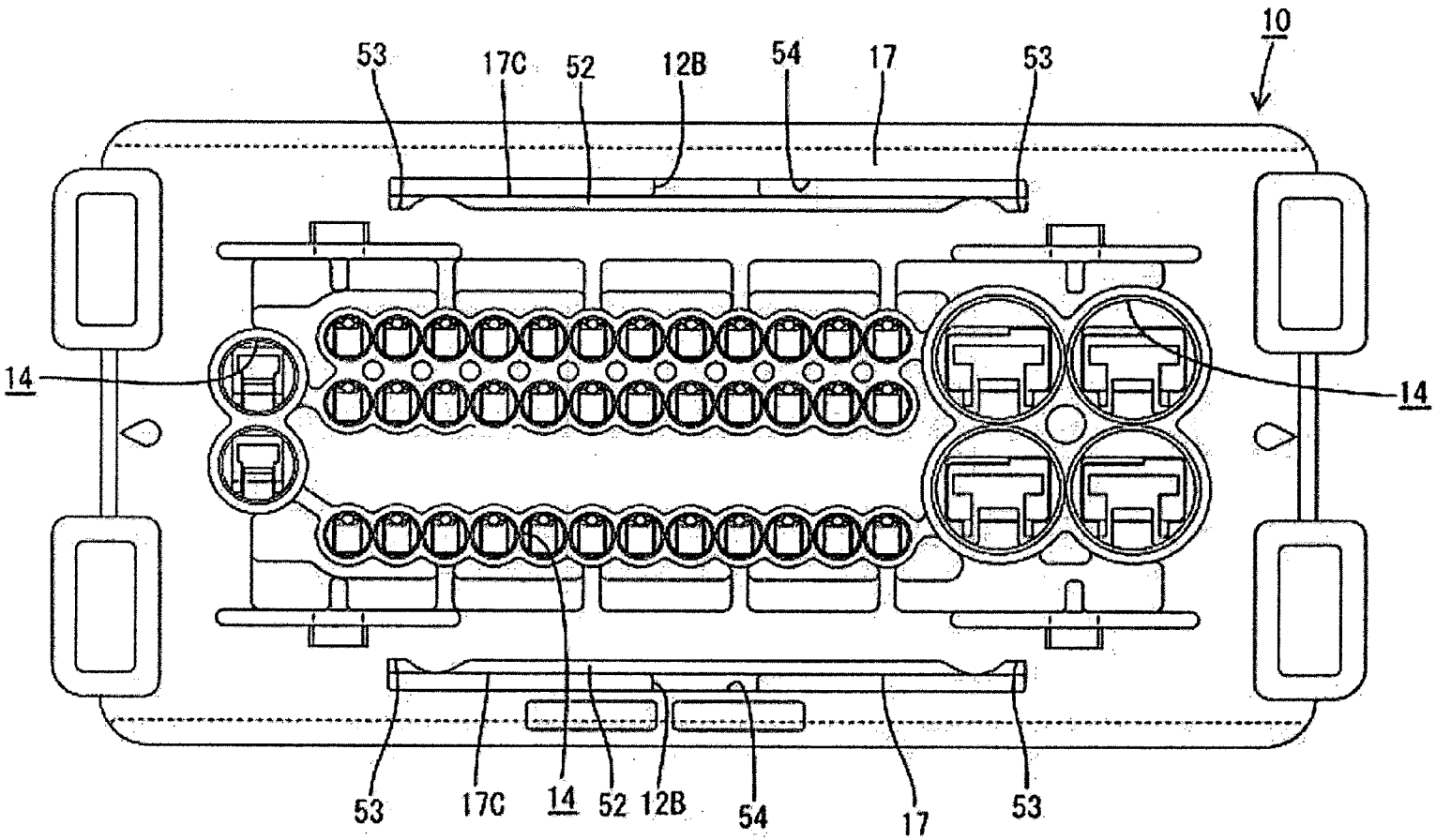
FIG. 14 is a rear view showing the female housing.
Figure 15:
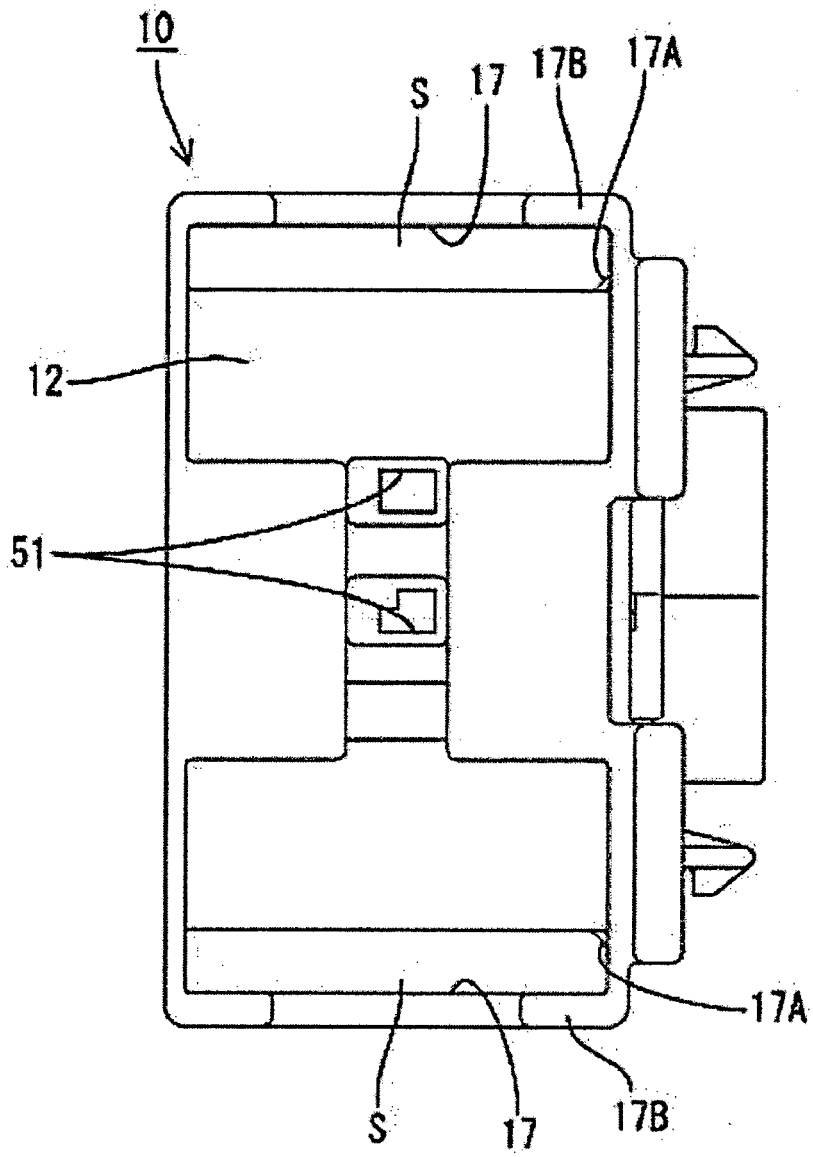
FIG. 15 is a side view showing the female housing.
Figure 16:
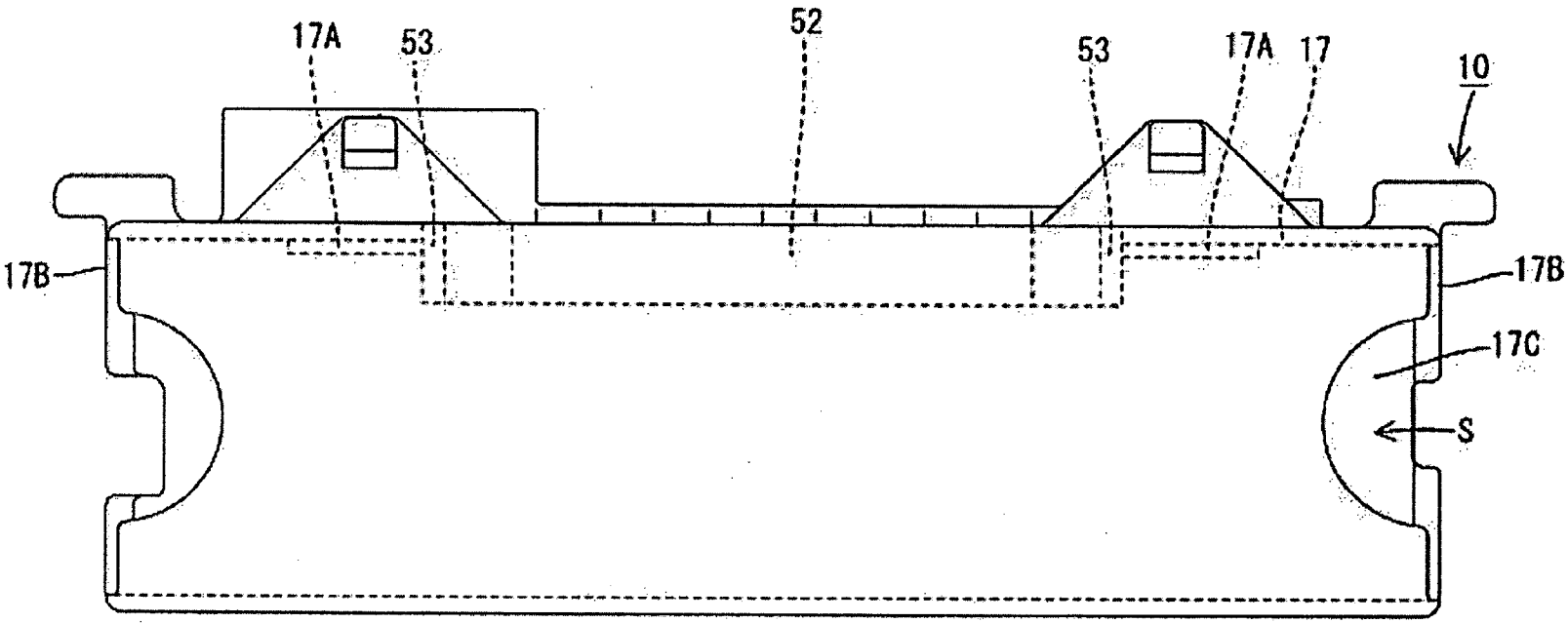
FIG. 16 is a plan view showing the female housing.
Figure 17:
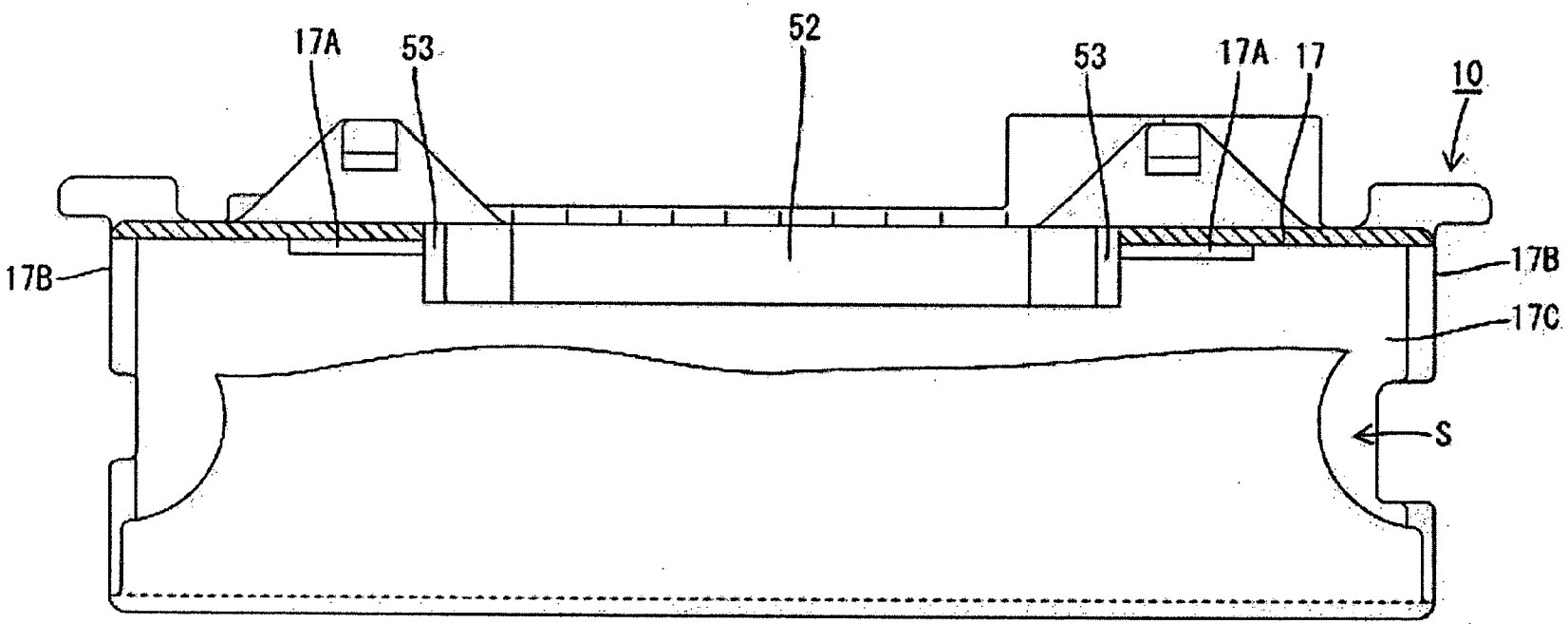
FIG. 17 is a partly cut-out plan view showing the female housing.

As shown in FIG. 14, wide upper and lower holes 54 are formed on a rear surface of the female housing 10 rearward of the accommodation spaces S. Left and right parts of each hole 54 are symmetrical with a central axis that extends vertically through the escape grooves 12B. An escape space 52 and two to-be-locked portions 53 are arranged widthwise on a cavity-side part of the rear surface of the female housing 10 constituting the holes 54. The to-be-locked portions 53 are disposed at outer sides of both ends of the holes 54 in the width direction of the female housing 10 and the escape space 52 is between the to-be-locked portions 53. A receiving surface 17C is opposed to the wall 17 and will oppose for the inner surface of the cam plate 31 in the thickness direction. The receiving surface 17C is concave to form the escape space 52 and the to-be-locked portion 53. A bottom surface of each of the escape space 52 and the to-be-locked portion 53 is formed at a position below the receiving surface 17C by one step and is almost parallel with the receiving surface 17C.

An inwardly facing surface of each to-be-locked portion 53 is substantially flush with a widthwise side edge of the hole 54 and is a substantially vertical sheer surface. An outwardly facing surface of each to-be-locked portion 53 has a gentle inclination. Inwardly facing surfaces of the escape space 52 that confront each other in the width direction of the female housing 10 have gentle inclination.

Figure 5:
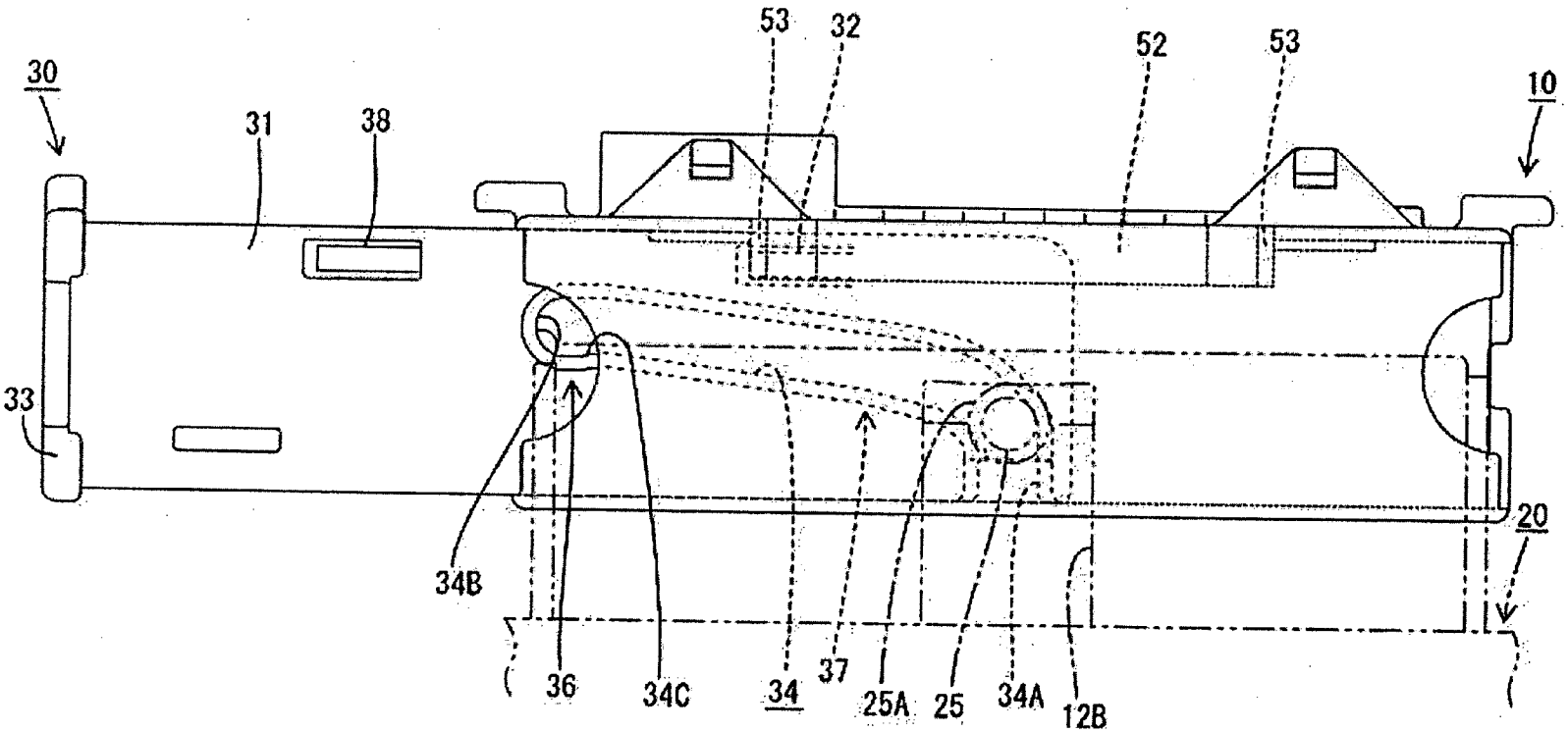
FIG. 5 is a plan view showing a state in which the operation of fitting both housings in each other has been started.
Figure 6:
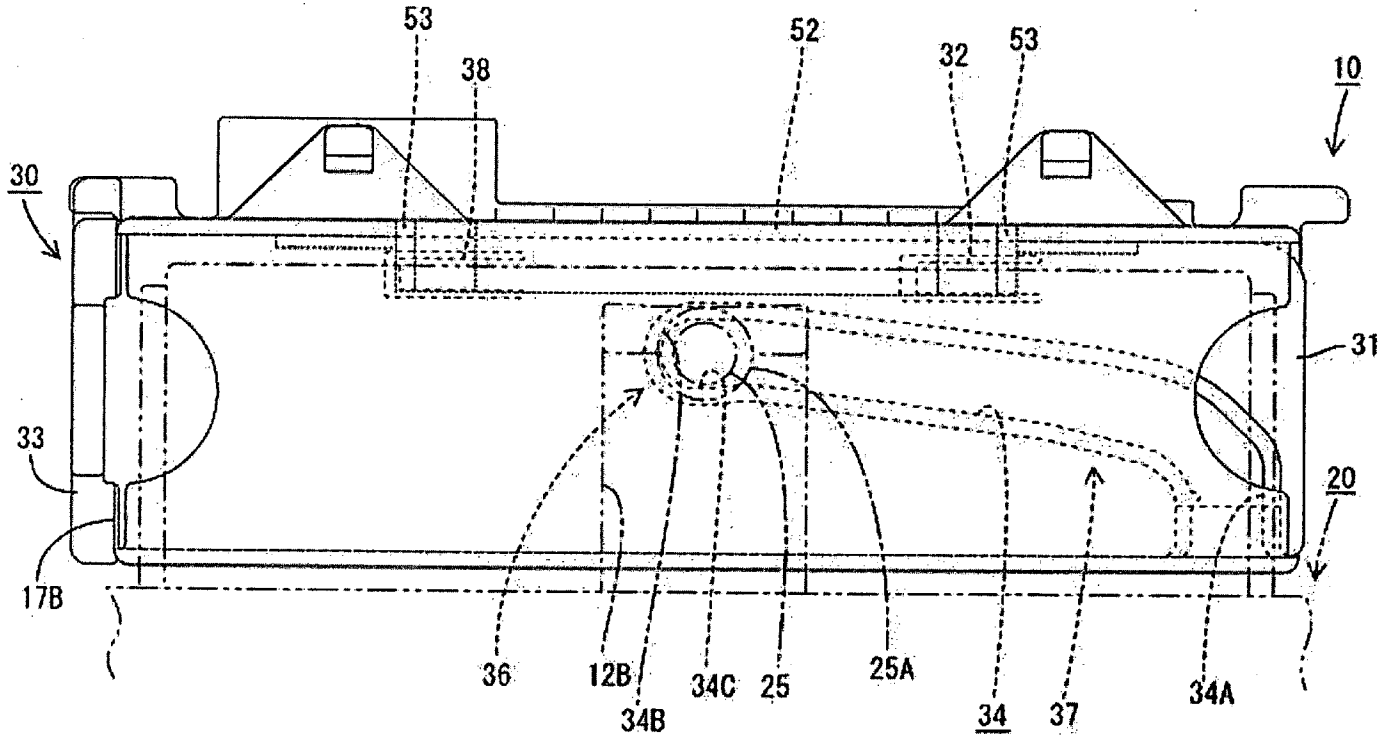
FIG. 6 is a plan view showing a state in which the operation of fitting both housings in each other has been completed.
Figure 8:
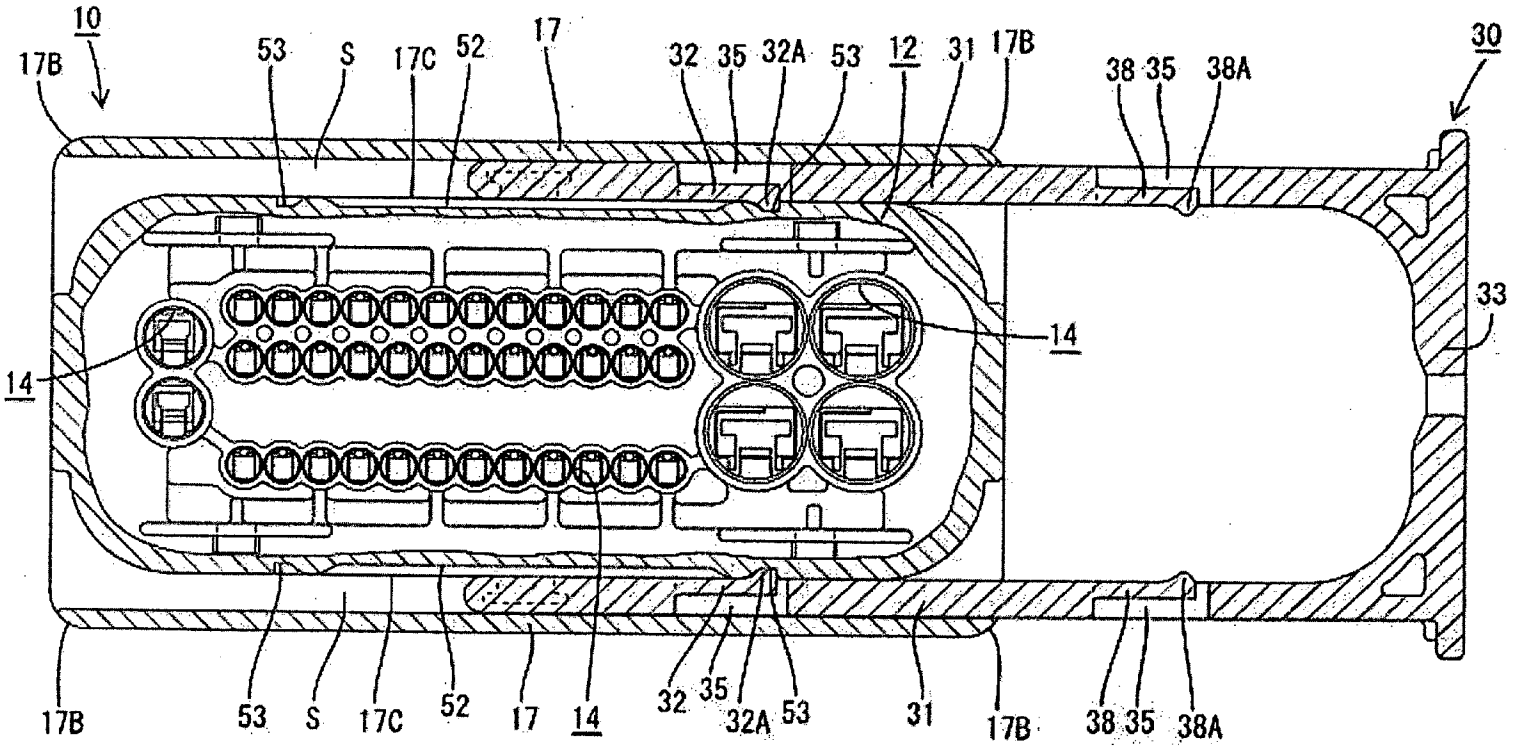
FIG. 8 is a vertical sectional view showing a state in which the slider is disposed at a wait position.
Figure 9:
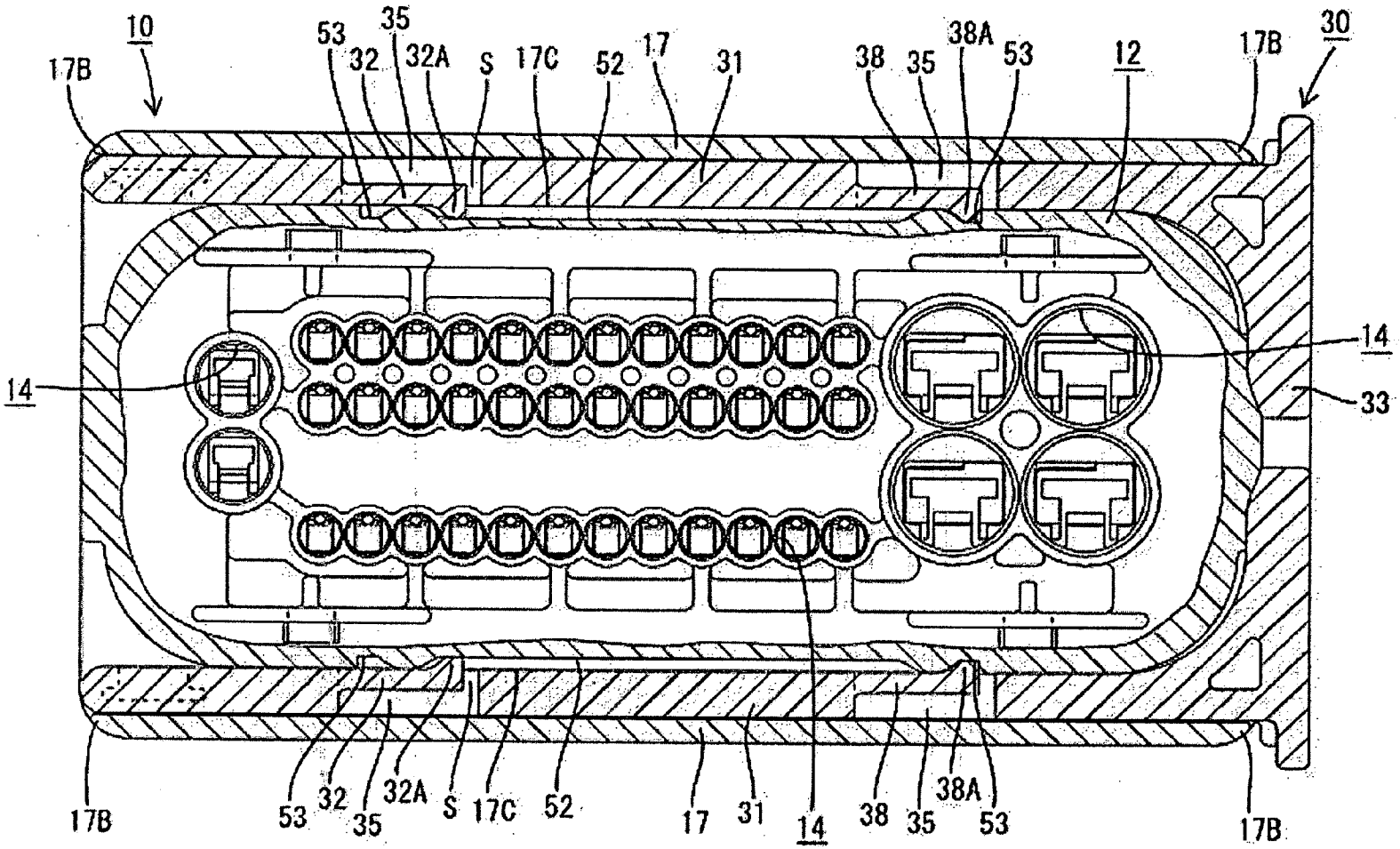
FIG. 9 is a vertical sectional view showing a state in which the slider is disposed at a fit-in position.

The wait position is the position of the slider 30 shown in FIG. 8 and the fit-in position is the position shown in FIG. 9. When the slider 30 is pressed from the wait position towards the fit-in position, a first locking projection 32A, which will be described later, rides across the gently inclined surface of the to-be-locked portion 53 so that the slider 30 does not interfere with the receiving surface 17C before and when the slider 30 reaches the fit-in position. Thus, a force for operating the slider 30 is low. The follower pin 25 of the male housing 20 can be received at an entrance 34A of a cam groove 34 through the escape groove 12B when the slider 30 is at the wait position, as shown in FIG. 5. As shown in FIG. 6, an inner surface of an operation portion 33 of the slider 30, which will be described later, contacts the open edge 17B of the wall 17, and the slider 30 cannot be pressed further.

The escape space 52 and the to-be-locked portion 53 are formed by moving a die for shaping them in the longitudinal direction through the hole 54. Therefore the die for use in the first embodiment is simple in its construction, provides good productivity, and makes the cost lower than a die that is moved vertically in the thickness direction of the cam plate 31 to shape the escape space 52 and the to-be-locked portion 53. More specifically, when the escape space 52 and the to-be-locked portion 53 are formed by vertical die cutting, it is necessary to use a slide die having a longitudinal cutting direction, which is the die cutting direction in which the cavities 14 are formed, a widthwise cutting direction which is the die cutting direction in which the accommodation space S is formed, and a vertical cutting direction. Such a slide die has a complicated construction and provides comparatively low productivity products. On the other hand, the slide die of the invention has a longitudinal cutting direction and a widthwise cutting direction. Thus the die for use in the invention has a comparatively simple construction.

Figure 19:
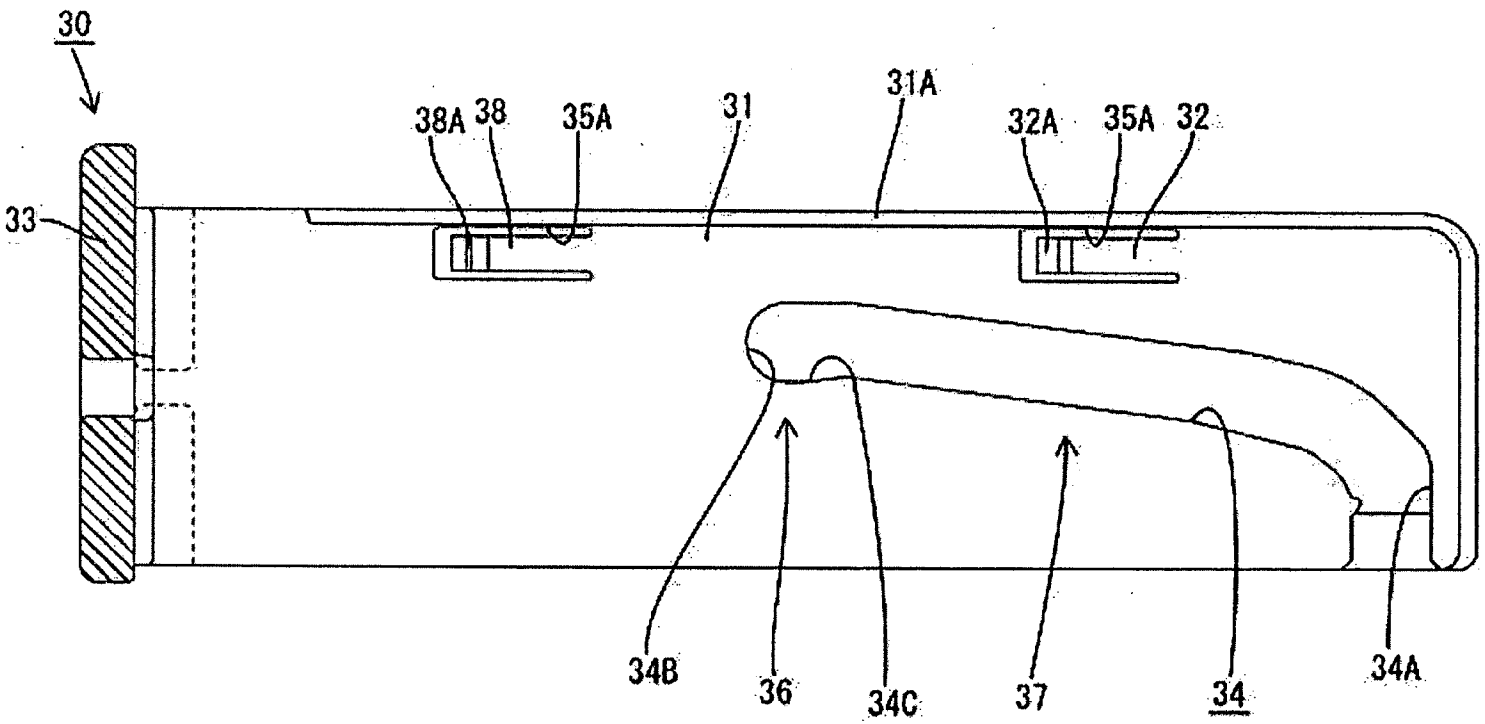
FIG. 19 is a partly cut-out plan view showing the slider.
Figure 20:
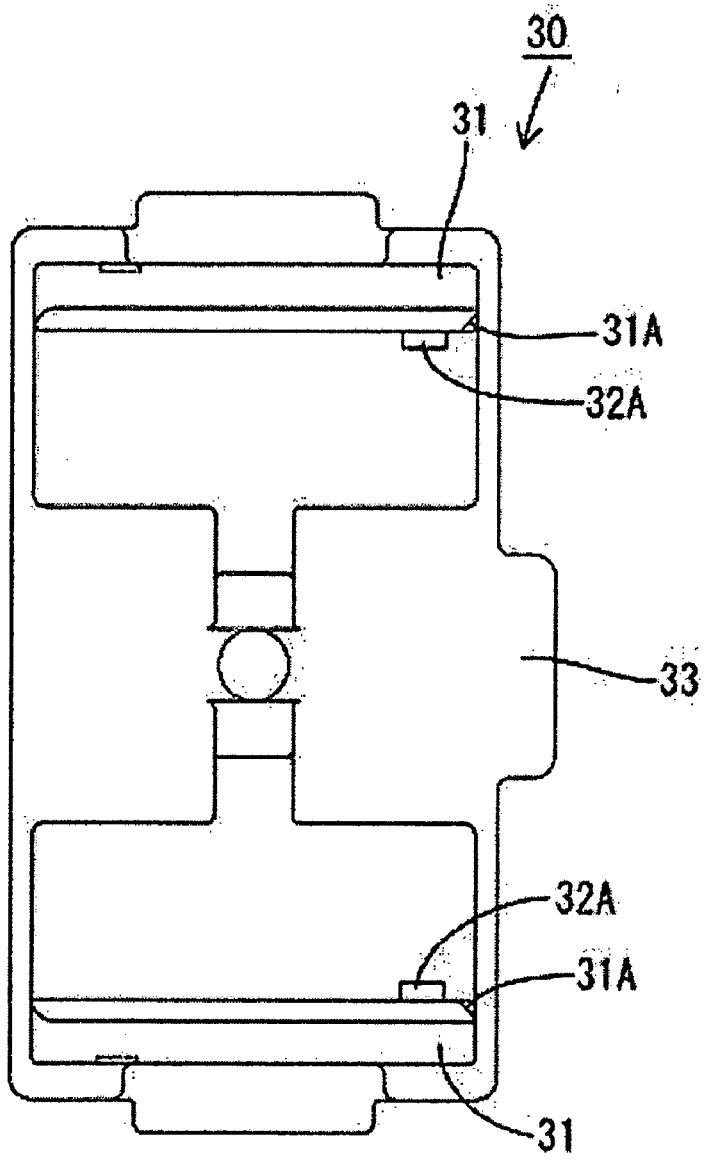
FIG. 20 is a side view showing the slider.
Figure 21:
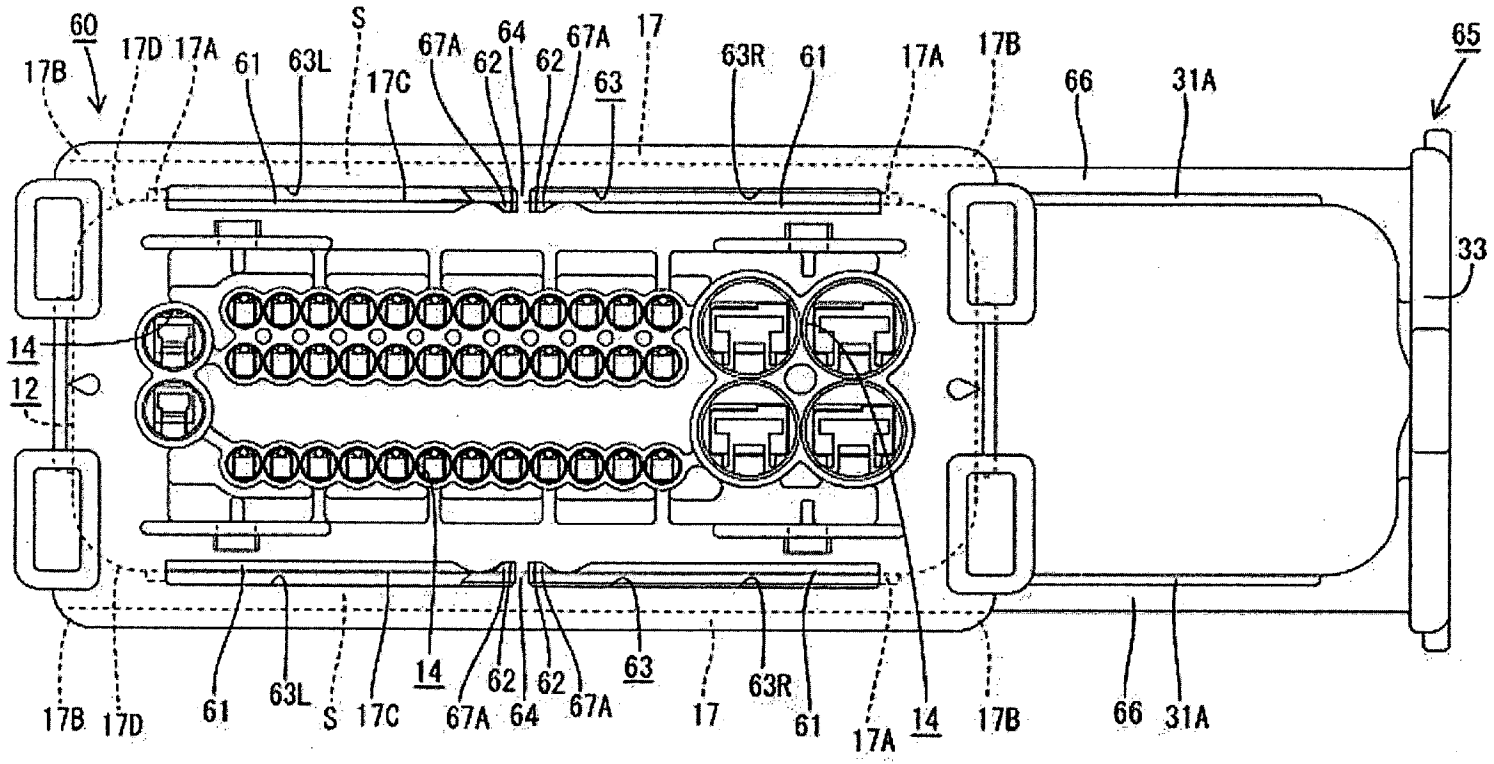
FIG. 21 is a rear view showing a state in which a slider of a second embodiment is disposed at a wait position.
Figure 22:
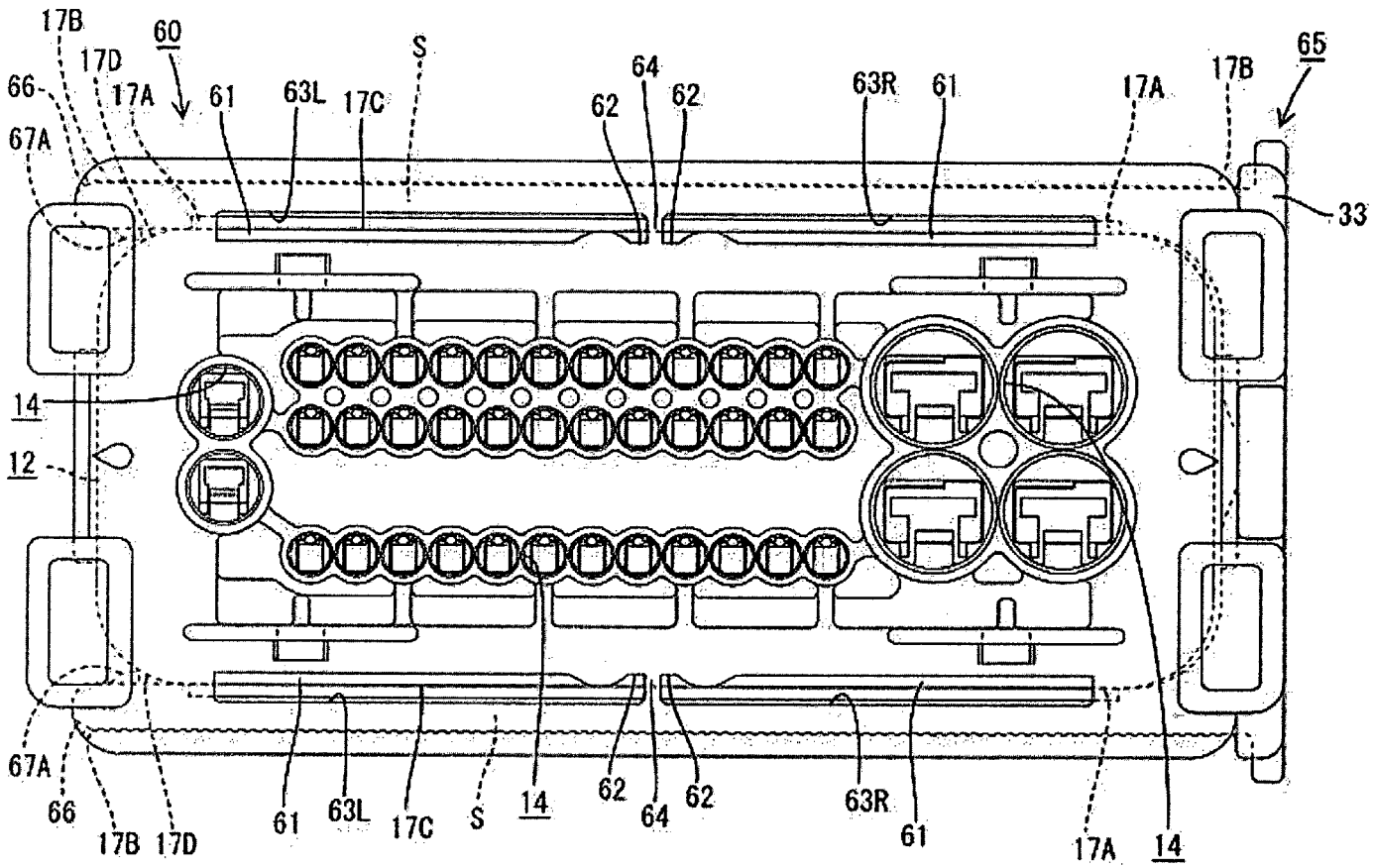
FIG. 22 is a rear view showing a state in which the slider is disposed at a fit-in position.
Figure 23:
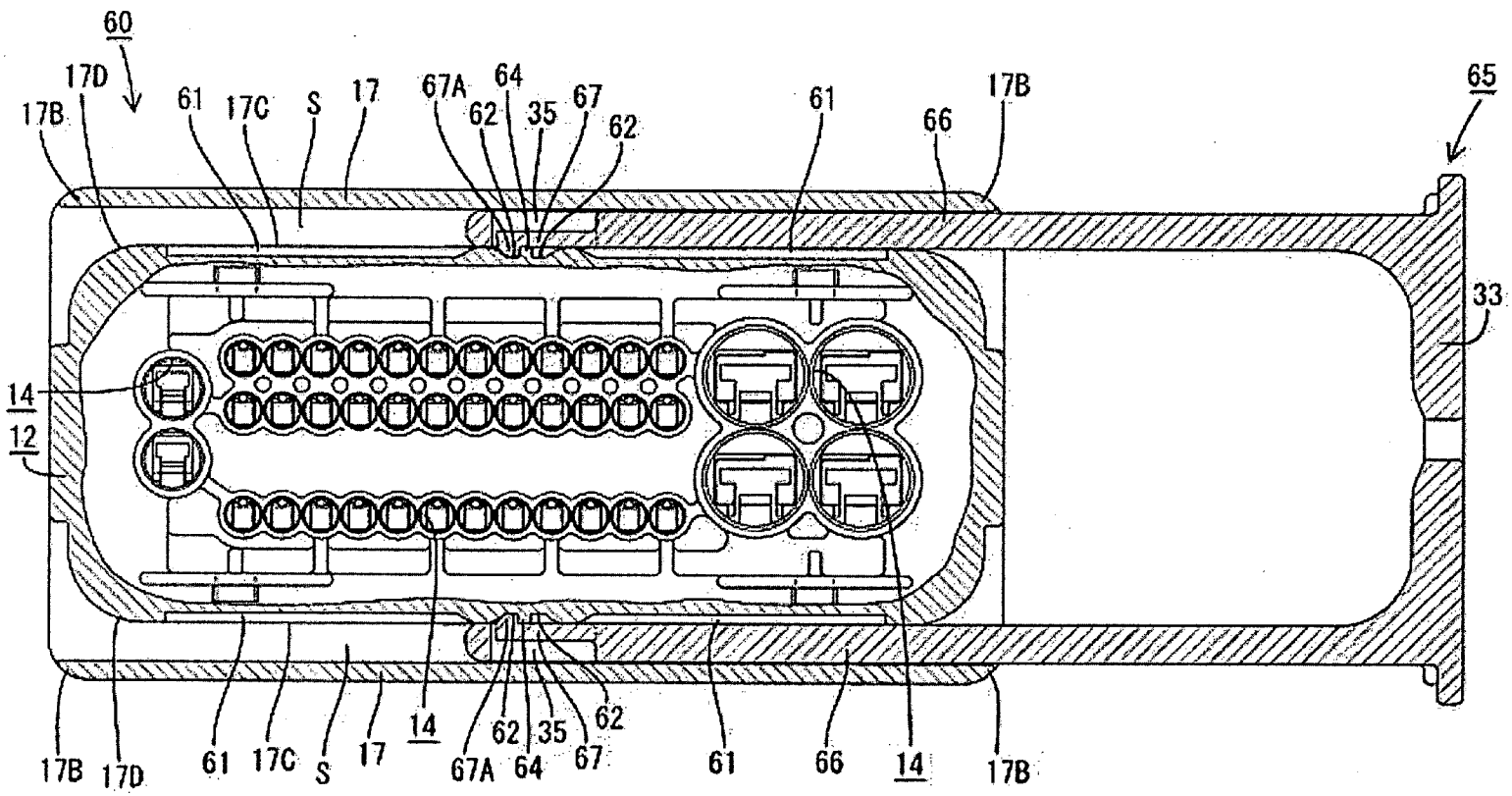
FIG. 23 is a vertical sectional view showing a state in which the slider is disposed at the wait position.
Figure 24:
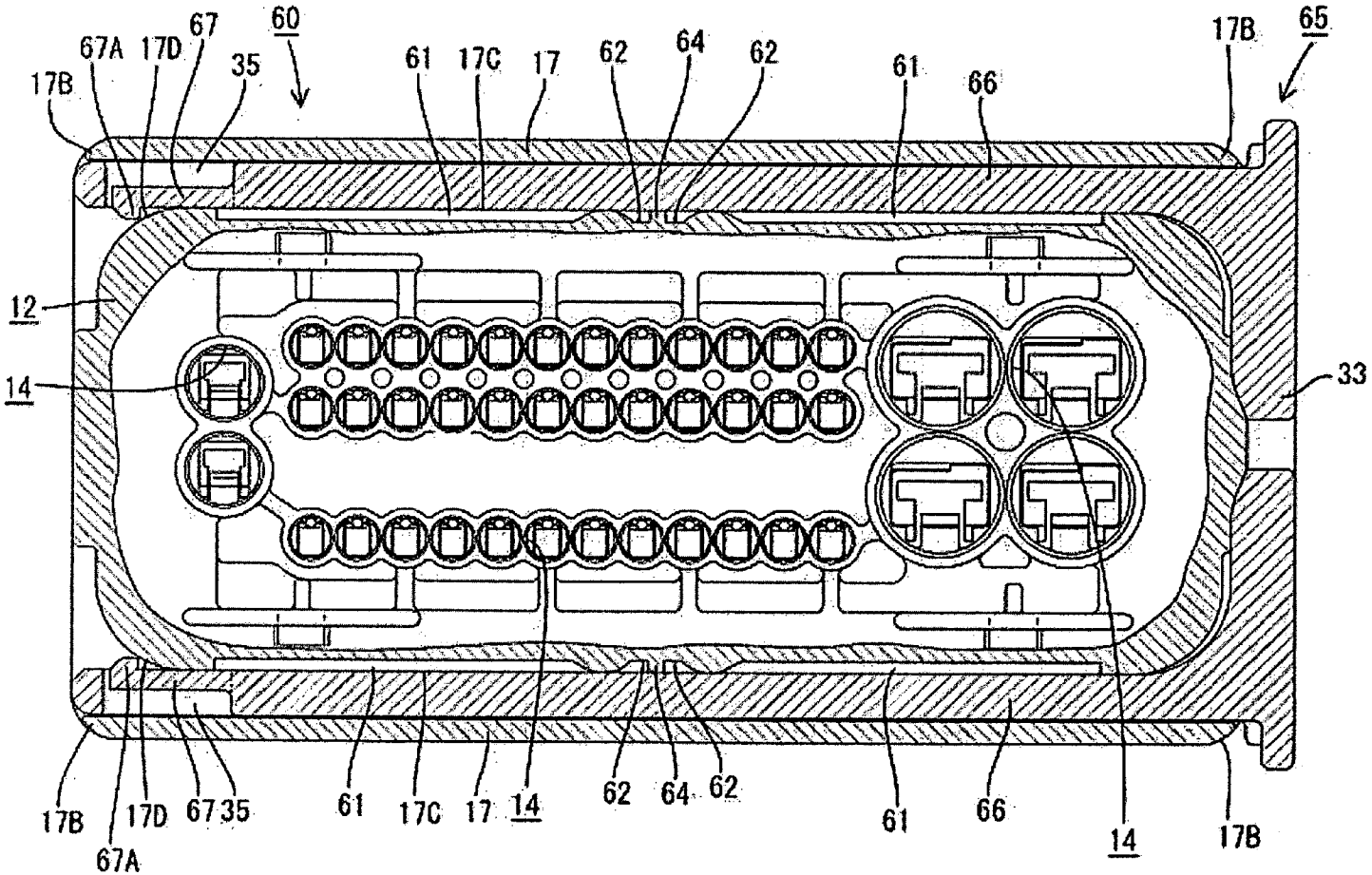
FIG. 24 is a vertical sectional view showing the state in which the slider is disposed at the fit-in position.
Figure 25:
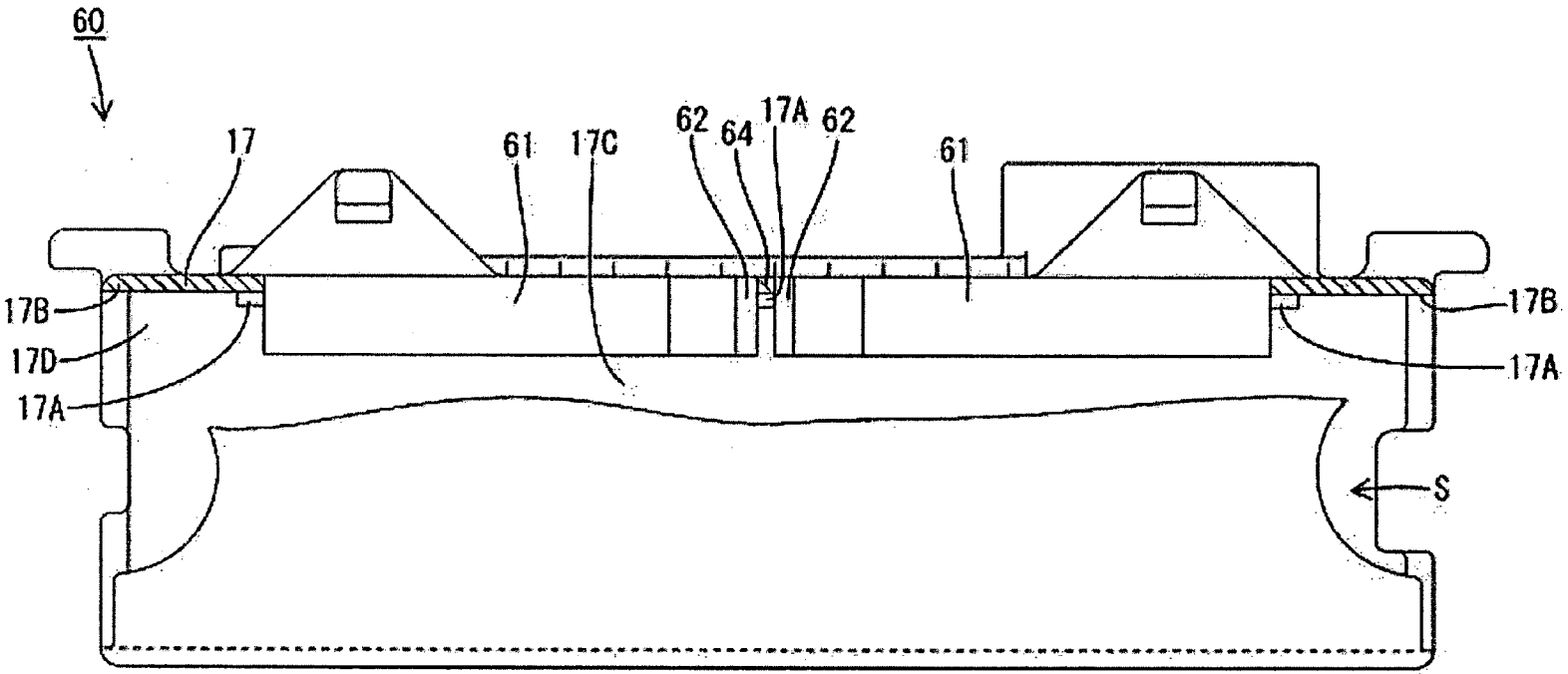
FIG. 25 is a partly cut-out plan view showing a female housing.

The slider 30 is made of synthetic resin, and has a U-shape defined by two cam plates 31 extending from opposite ends of an operation portion 33, as shown in FIG. 1. The slider 30 can be mounted on the female housing 10 from either side of the accommodation space S, and the mounting direction is selected according to a situation of the job site where the slider 30 engages the male housing 20. The slider 30 is mounted on the female housing 10 from an opening at the selected side and is movable between the wait position and the fit-in position. As shown in FIG. 19, a chamfer 31A is formed by cutting out a corner of an inner surface of the cam plate 31 from a rear end where first and second locks 32, 38 are disposed to a front end thereof. A sliding operation can be accomplished easily by pressing the operation portion 33 towards the female housing 10.

Figure 18:
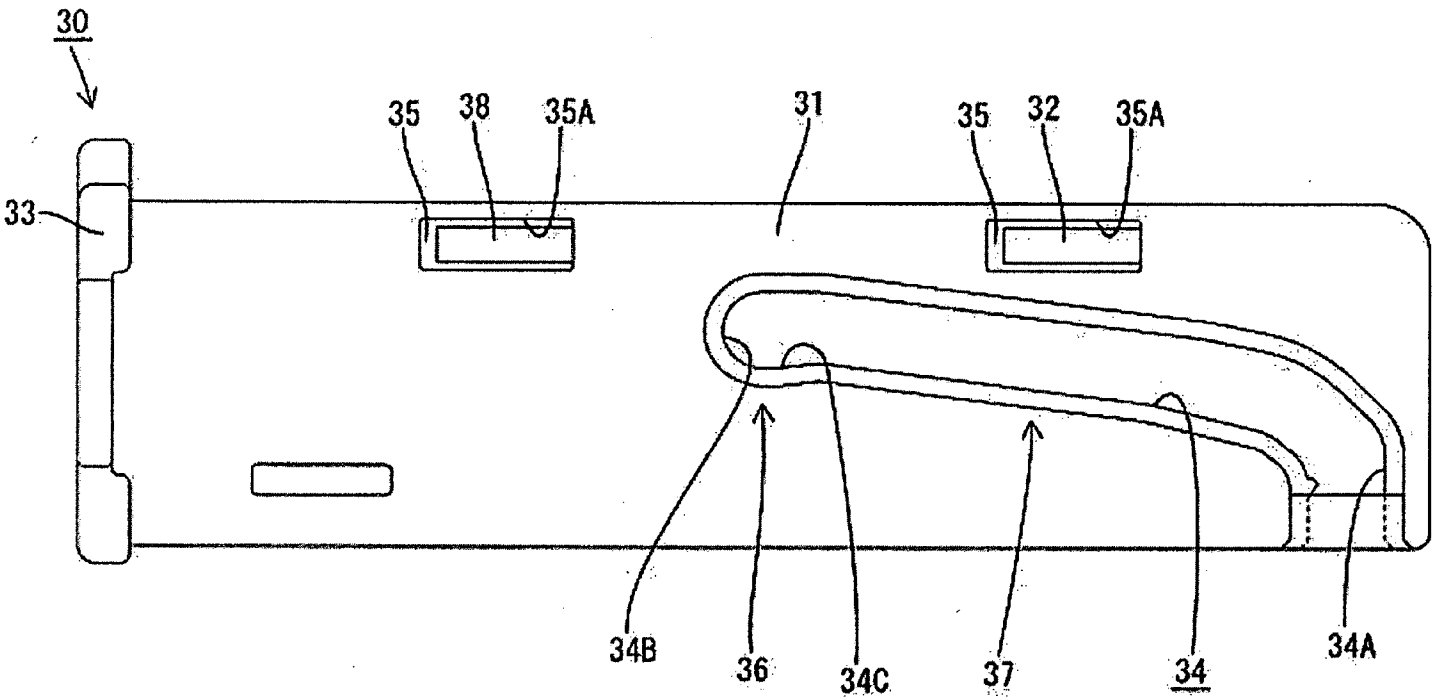
FIG. 18 is a plan view showing the slider.

As shown in FIG. 18, a cam groove 34 is formed on each cam plate 31 and is capable of engaging one of the follower pins 25 of the male housing 20. Each cam groove 34 penetrates through the respective cam plate 31 in the thickness direction of the cam plate 31. Additionally, each cam groove 34 has an idle region 36 and an operational region 37. The operational region 36 allows the housings 10, 20 to attain a fit-in state. The idle region 36 is continuous with a rear side of the operational region 37 and does not contribute to fitting the housings 10, 20 together. The inner part of the cam plate 31 projects into the cam groove 34 parallel with surface of cam plate 31 and the flange 25A of the follower pin 25 locks to the projected portion of the cam plate 31 from an outer side. Thus, the cam plates 31 cannot open and the follower pin 25 remains engaged with the cam groove 34.

The operational region 37 is oblique to both the fit-in direction of the housings 10, 20 and the insertion direction of the slider 30 and extends from the entrance 34A at the front end of the cam plate 31 to approximately a central portion thereof. Thus, when the slider 30 is at the wait position, the follower pin 25 of the male housing 20 is advanced into the entrance 34A of the cam groove 34. The housings 10, 20 attain the fit-in state due to a cam action between the follower pin 25 and the cam groove 34. As shown in FIG. 5, the entrance 34A of the cam groove 34 and the escape groove 12B align when the slider 30 is at the wait position, and the follower pin 25 can advance into the entrance 34A of the cam groove 34 through the escape groove 12B.

The idle region 36 extends from an end of the operational region 37 to an end 34B of the cam groove 34 along the advance direction of the slider 30. The housings 10, 20 are in the fit-in completed state when the follower pin 25 is in the idle region 36. As shown in FIG. 6, the follower pin 25 is at the end 34B of the cam groove 34 when the slider 30 is at the fit-in position. A front edge 34C of the cam groove 34 in the idle region 36 gradually inclines towards the end 34B of the cam groove 34. Thus, when the connected housings 10, 20 are pulled in opposite directions, the follower pin 25 engages the front edge 34C of the cam groove 34 in the idle region 36. Accordingly, a component force acts along the advance direction of the slider 30 to prevent the housings 10, 20 from separating.

As shown in FIG. 19, the first and second locks 32 and 38 are formed rearward from the cam groove 34 of the cam plate 31 and are spaced at a predetermined interval in the width direction of the cam plate 31. The first lock 32 is at a front side of the cam plate 31. The second lock 38 is rearward from the first lock 32 and hence closer to the operation portion 33. Two flexible spaces 35 are formed in the cam plate 31 and have a depth (vertical dimension) that extends in thickness of the cam plate 31 from the respective lock 32, 38 to the outer surface of the cam plate 31. Thus, the flexible spaces 35 open outward in the thickness direction of the cam plate 31. The first and second locks 32 and 38 are formed in the remainder of the entire thickness of the cam plate 31, and inward of the flexible spaces 35. Each of the first and second locks 32 and 38 is cantilevered towards the operation portion 33. Thus, portions of the first and second locks 32 and 38 closer to the operation portion 33 are flexible out in the thickness direction of the cam plate 31 about a portion of the respective lock 32, 38 closer to the front end of the cam plate 31. First and second locking projections 32A, 38A are formed at a free ends of the inner surfaces of the first and second locks 32 and 38. A surface of each of the first and second locks 32 and 38 adjacent to the respective locking projection 32A, 38A and opposite to the flexible space 35 is flush with the inner surface of the cam plate 31.

The first locking projection 32A has a gently inclined surface at its front side and as a sheer surface normal to the plane of the cam plate 31 at the facing side facing the operation portion 33. When the slider 30 is at the wait position, the sheer surface of the first locking projection 32A is locked to the sheer surface of the to-be-locked portion 53 so that the slider 30 cannot move from the wait position from moving in a removal direction (see FIG. 8). The gently inclined surface of the first locking projection 32A is locked to the gently inclined surface of the to-be-locked portion 53, thus holding the slider 30 at the wait position in a state in which the slider 30 is movable towards the fit-in position.

The second locking projection 38A has gently inclined surfaces at both its front side and the side of the operation portion 33. When the slider 30 is disposed at the wait position, both inclined surfaces of the second locking projection 38A are outside the accommodation space S. When the slider 30 is disposed at the fit-in position, both inclined surfaces of the second locking projection 38A are locked to the inner wall of the to-be-locked portion 53, thus holding the slider 30 at the fit-in position in a state in which the slider 30 is movable towards the wait position (see FIG. 9). When the slider 30 moves between the wait position and the fit-in position, the second locking projection 38A slides on the receiving surface 17C, to flex the second locking portion 38 outward in the thickness direction of the cam plate 31.

The flexible space 35 is formed by cutting a die for shaping the flexible space 35 from the outer side of the cam plate 31 to the inner side thereof in the thickness direction. Consequently a peripheral wall 35A extends around the entire periphery of flexible space 35. Thus, the cam plate 31 is stronger than a cam plate formed by cutting the die for shaping the flexible space 35 in the longitudinal direction of cam plate 31. That is, if the flexible space was shaped by cutting the die orthogonal to the flexible direction of the locks, as in the prior art, a hole is formed at the periphery of the cam plate. Thus, the periphery of the cam plate is not continuous adjacent to the prior art lock and the prior art cam plate is relatively weak. On the other hand, the flexible space 35 of the invention is formed by cutting the die along the flexible direction of the first and second locks 32 and 38. Thus, the peripheral wall 35A can be formed over the whole length of the periphery thereof and it is possible to secure the strength of the peripheral portion of the flexible space 35 of the cam plate 31.

Figure 7:
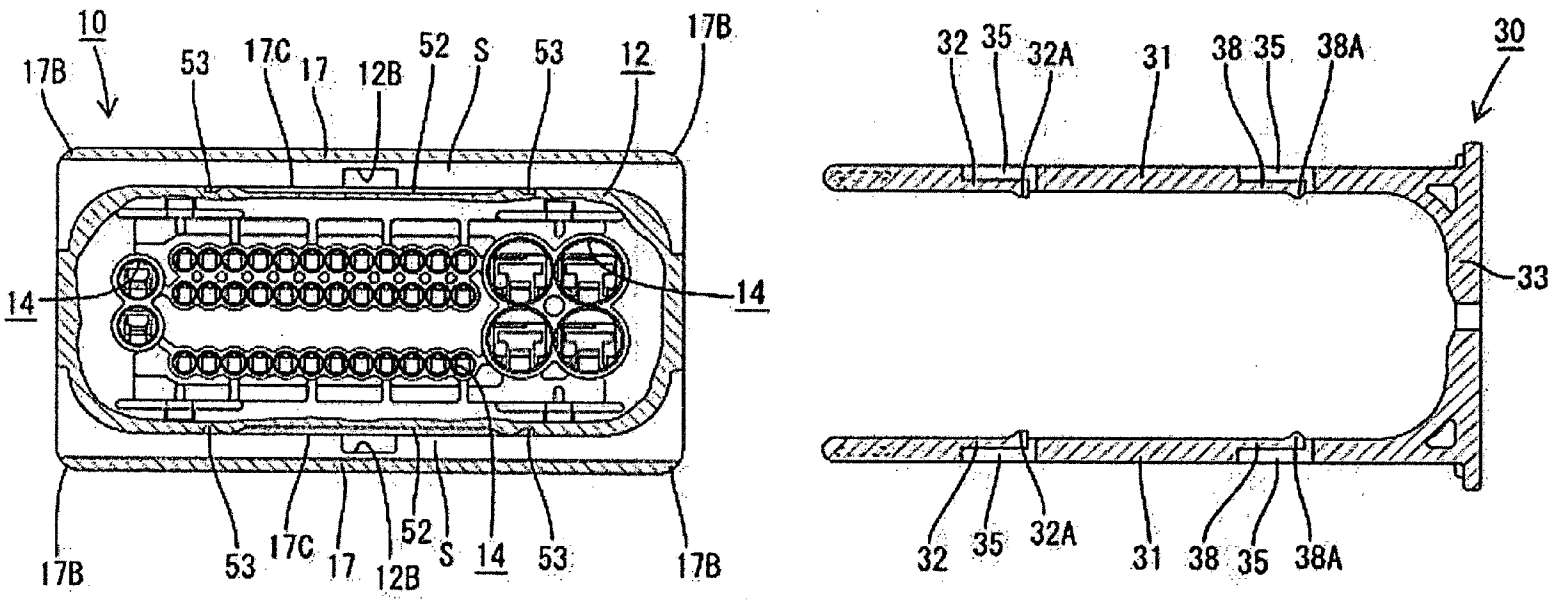
FIG. 7 is a vertical sectional view showing a state before a slider is mounted on the female housing.
Figure 12:
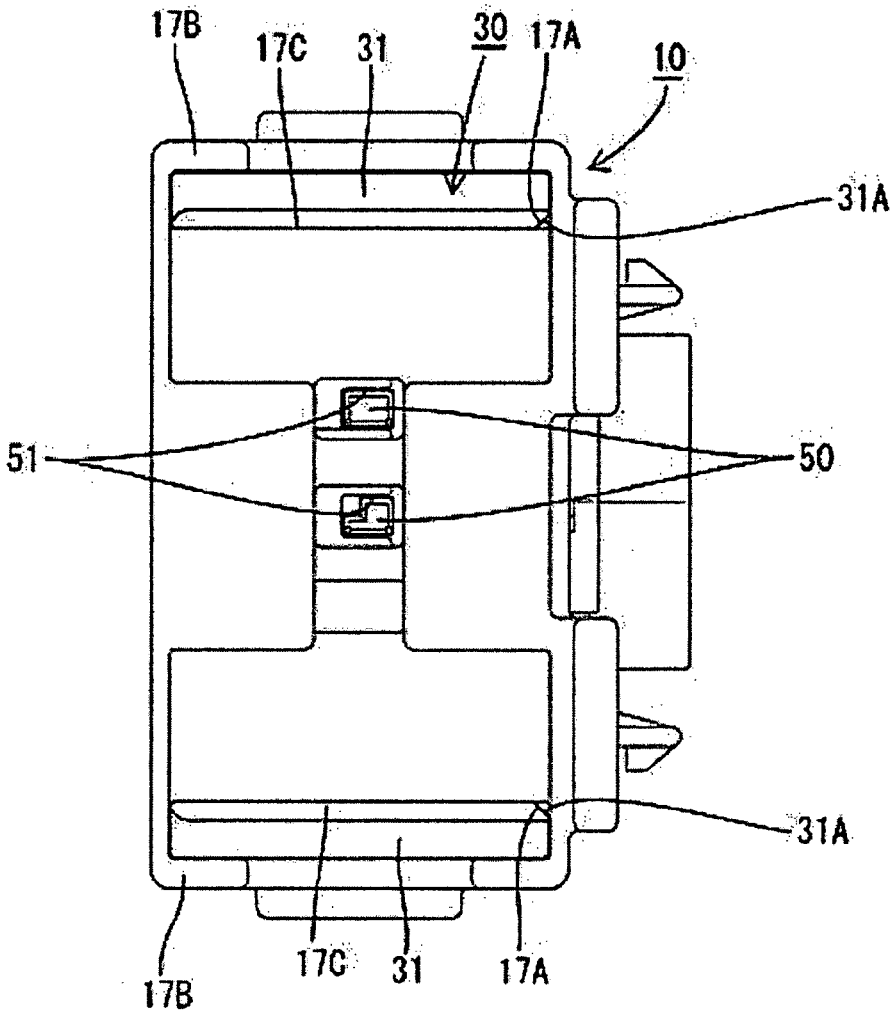
FIG. 12 is a side view showing the state in which the slider is disposed at the fit-in position.

The connector is assembled initially by mounting the slider 30 on the female housing 10. As shown in FIG. 7, the slider 30 can be mounted on the female housing 10 from either side of the accommodation space S and the direction in which the slider 30 is mounted is selected according to a situation at the job site. As shown in FIG. 12, the chamfered surface 31A of the cam plate 31 confronts the tapered surface 17A of the wall 17 as the slider 30 is mounted on the female housing 10. As a result, the slider 30 cannot be inserted into the accommodation space S in an inverted orientation. Both inclined surfaces of the second locking projection 38A of the second lock 38 are locked to the inner wall of the to-be-locked portion 53 when the slider 30 has reached the fit-in position. Thus, the slider 30 is held at the fit-in position, but is movable towards the wait position. On the other hand, the first locking projection 32A of the first lock 32 is disposed inside the escape space 52 and is prevented from interfering with the receiving surface 17C. Additionally, the first lock 32 is not kept in a flexed state.

The female housing 10 is fed to the location where the slider 30 will be engaged with the male housing 20. The slider 30, at this time, is at the fit-in position (FIG. 9). However, the slider 30 must be moved from the fit-in position (FIG. 9) to the wait position (FIG. 8) for engagement with the male housing 20. In returning the slider 30 to the wait position, the second locking projection 38A rides over the receiving surface 17C and slides in contact with the inner wall of the to-be-locked portion 53. The first locking projection 32A rides over the inclined surface at the slider-mounting side of the inner wall of the escape groove 12B and fits into the to-be-locked portion 53. At this time, the second locking projection 38A moves out of the accommodation space S (see FIG. 8). At this time, the sheer surface of the first locking projection 32A engages the sheer surface of the to-be-locked portion 53 to prevent the slider 30 from moving farther in the removal direction. Additionally, the gently inclined surface of the first locking projection 32A is locked to the gently inclined surface of the to-be-locked portion 53, thus holding the slider 30 at the wait position in a state in which the slider 30 is movable toward the fit-in position. In this state, the entrance 34A of the cam groove 34 aligns with the escape groove 12B, and waits for follower pin 25 to enter the cam groove 34.

The housings 10, 20 then are fit together. Initially the guide projection of the male housing 20 is advanced into the concave guide 12A of the female housing 10 to achieve a shallow fit of the female housing 10 on the male housing 20 and to ensure a smooth fitting of the housings 10, 20 together. The follower pin 25 then is advanced through the escape groove 12B and into the entrance 34A of the cam groove 34, as shown in FIG. 5. The slider 30 then is pressed to the fit-in position, and the connection of the housings 10, 20 progresses due to the cam action between the follower pin 25 and the cam groove 34. The housings 10, 20 have been fit together when the slider 30 is at the fit-in position, and the second locking projection 38A is locked to the inner wall of the to-be-locked portion 53. Thus, as shown in FIG. 9, the slider 30 is held at the fit-in position, but is movable towards the wait position.

The first lock 32 deforms elastically and enters the escape space 52 while the slider 30 is moving from the wait position to the fit-in position, and the first locking projection 32A is in contact with the gently inclined surface of the to-be-locked portion 53. The entry of the first lock 32 into the escape space 52 allows the first lock 32 to return to its original state. The first lock 32 keeps the undeformed posture until and when the slider 30 reaches the fit-in position, and thus the first locking projection 32A will not interfere with the receiving surface 17C. The unflexed state of the first lock 32 reduces the operational force required to press the slider 30 to the fit-in position and prevents the first lock 32 from plastically deforming. Thus, it is possible to prevent a decrease of an elastic reaction force.

The slider 30 is returned from the fit-in position towards the wait position to separate the housings 10, 20. As a result, the cam action between the follower pin 25 and the cam groove 34 separates the housings 10, 20. The follower pin 25 is at the entrance 34A of the cam groove 34 when the slider 30 reaches the wait position and it is possible to separate the housings 10, 20 from each other.

By cutting or moving the die for shaping the flexible space 35 from the inner side toward the outer side along the thickness direction of the cam plate 31, the peripheral wall 35A of the flexible space 35 of the slider 30 is formed over the entire periphery of the flexible space 35. Therefore, the cam plate 31 is strong.

The slider 30 is movable between the wait position where the follower pin can be received at the entrance of the cam groove 34 and the fit-in position where both housings 10, 20 are fit together. However, it is possible to hold the slider 30 releasably at the wait position or at the fit-in position. Thus, inadvertent movement of the slider 30 is unlikely.

The accommodation space S penetrates through female housing 10 in the width direction so that the slider 30 can be inserted selectively from either side. Therefore the mounting direction of the slider 30 can be selected according to a situation of the job site in which the slider is mounted.

The chamfered surface 31A is formed on the cam plate 31 and the tapered surface 17A is formed on the space-constituting portion 17. The tapered surface 17A matches the chamfered surface 31A when the cam plate 31 is oriented properly and permits the insertion of the cam plate 31 into the accommodation space S. However, the tapered surface 17A does not match the cut-out surface 31A when the cam plate 31 is oriented improperly and prevents the insertion of the cam plate 31 into the accommodation space S. Therefore the slider 30 is assured of being inserted properly into the accommodation space S.

The die for shaping the escape space 52 and the to-be-locked portion 53 is cut or moved along the fit-in direction of the housings 10, 20. Thus, the hole 54 is formed on the surface of the female housing 10 orthogonal to the fit-in direction. Accordingly it is possible to use a slide die having two cutting or moving directions. Thereby it is possible to simplify the construction of the die and decrease the cost.

The slider 30 has two cam plates 31 and the operation portion 33 connecting the ends of the cam plates 31, 31. Thus, the slider 30 can be inserted easily by pressing the operation portion toward the female housing 10.

A second embodiment is described below with reference to FIGS. 21 through 25. The second embodiment differs from the first embodiment with respect to the construction for locking the female housing and the slider together. Other elements of the second embodiment are the same as the first embodiment and are not described again. The second embodiment has a female housing 60 with an escape space 61 of a female housing 60 and a to-be-locked portion 62. Wide upper and lower holes 63 are formed in the female housing 60 for cutting a die for shaping the escape space 61 and the to-be-locked portion 62 thereof is long in the width direction of the female housing 60. A tubular fit-in portion 12 is sandwiched therebetween similarly to the hole 54 of the first embodiment. A partitioning wall 64 is formed between vertically opposed wall surfaces of the hole 63 and divides the hole 63 into a left hole 63L and a right hole 63R that are symmetrical with respect to an axis passing vertically through the partitioning wall 64. The following description of the left hole 63L also applies to the right hole 63R.

The escape space 61 and the to-be-locked portion 62 are arranged in the width direction of the female housing 60 outwardly of the cavities 14. The escape space 61 is formed by the receiving surface 17C that extends concavely from an edge of the left hole 63L opposite to the partitioning wall 64 in the width direction of the female housing 60. The to-be-locked portion 62 is formed by a concavity in the receiving surface 17C at the side of the partitioning wall 64. Similar to the first embodiment, the escape space 61 and the to-be-locked portion 62 are formed by longitudinally cutting a die through the hole 63.

A surface of the inner wall of the to-be-locked portion 62 at the side of the partitioning wall 64 is flush with an edge of the periphery of the left punched hole 63L at the side of the partitioning wall 64 and is formed as a sheer surface normal to the width direction. A surface of the inner wall of the to-be-locked portion 62 at a side opposite to the partitioning wall 64 is inclined gently and a surface of the escape space 61 at the side of the partitioning wall 64 also is inclined gently. An inner wall surface of the escape space 61 at the side opposite to the partitioning wall 64 is flush with a peripheral edge of the left hole 63L opposite to the partitioning wall 64 and is a sheer surface normal to the width direction. Bottom surfaces of the escape space 61 and the to-be-locked portion 62 are lower than the receiving surface 17C by one step and almost parallel with the receiving surface 17C. The heights of the bottom surface of the escape space 61 and the to-be-locked portion 62 are almost equal to or a little larger than that of a locking projection 67A.

A slider 65 has two cam plates 66. A lock 67 corresponding to the first lock 32 is formed at the front side of the cam plate 66, similar to the slider 30 of the first embodiment. However, a lock corresponding to the second lock 38 is not formed on the cam plate 66 at the side of the operation portion 33. The slider 65 can be mounted on the female housing 60 from both sides of the accommodation space S, and the mounting direction of the slider 65 can be selected according to a situation at the job site in which the slider 65 is mounted on the male housing 20. The slider 65 is mounted on the female housing 60 from one opening disposed at the side opposite to the corresponding to-be-locked portion 62 with respect to an axis vertically passing through the partitioning wall 64.

A locking projection 67A is formed at a free-end of the lock and on an inner surface of the cam plate 66. The locking projection 67A has a gently inclined front surface and a sheer rear surface normal to the cam plate 66 at the side of the operation portion 33. When the slider 65 is at the wait position, the sheer surface of the locking projection 67A is locked to the sheer surface of the to-be-locked portion 62, thus preventing the slider 65 at the wait position from moving in a removal direction (see FIG. 23). The gently inclined surface of the locking projection 67A is locked to the gently inclined surface of the to-be-locked portion 62, thus holding the slider 65 releasably at the wait position.

When the slider 65 is inserted into the accommodation space S, the locking projection 67A rides across the gently inclined surface, enters the escape space 61 and moves towards the fit-in position, with the locking projection 67A avoiding interference with the receiving surface 17C. The locking projection 67A then rides over the receiving surface 17C and slides in contact with an upper edge of the sheer surface of the escape space 61. The locking projection 67A then moves towards the fit-in position, with the locking projection 67A sliding in contact with the receiving surface 17C, to enter a curved portion 17D that curves along a periphery of the fit-in portion 12 at both ends of the receiving surface 17C in the width direction. As a result, the lock 67 gradually returns towards its original state and returns completely to its original state when the slider 65 reaches the fit-in position. The locking projection 67A locks to the curved portion 17D of the receiving surface 17C to hold the slider 65 releasably at the fit-in position.

As described above, because in the second embodiment, the to-be-locked portion 62 and the curved portion 17D are formed on the female housing 60. Thus, the slider 65 needs only the one lock 67 and not the two locks on the slider 65 of the first embodiment. Accordingly, there are fewer portions with flexible spaces that lead to weakening of the cam plate 65. Therefore, it is possible to simplify the construction of the slider 65 and to secure the strength of the cam plate 66. Further the partitioning wall 64 dividing the punched hole 63 into the left and right sides is formed between opposed wall surfaces of the hole 63 of the female housing 60. Thus, the peripheral portion of the hole 63 is strengthened.

The invention is not limited to the embodiment described above. For example, the following embodiments are included in the technical scope of the invention, and still other modifications can be made without departing from the spirit and scope of the invention.

The slider is U-shaped in the above-described embodiment. However, the slider may be formed as one flat plate.

The escape space is made concave toward the cavity 14. However, provided that the cutting direction of the die for shaping the escape space is longitudinal, other modes may be adopted. For example, the surface, of the wall 17 that is opposite to the cavity 14 may be concave.

The lock holds the slider at the fit-in position in the above-described embodiment. However, the slider does not necessarily have to be held at the fit-in position. In that case, it is necessary that the idle region 36 does not contribute to the fit-in of the housings. Further, the front edge 34C of the cam groove 34 in the idle region 36 should be inclined to allow the generation of a component force for pressing the slider to the fit-in position when the housings are pulled to opposite directions.

The tapered surface 17A and the cut-out surface 31A prevent the female and male housings from being fit together in an erroneous orientation when the slider is mounted on the female and male housings. However, other modes may be provided so long as they are capable of preventing the housings from being fit together erroneously. For example, a projection may be provided instead of the tapered surface 17A and a concave portion capable of engaging the projection may be provided instead of the cut-out surface 31A.

The component force for pressing the slider to the fit-in operation position is generated by the engagement between the follower pin 25 and the front edge 34C of the cam groove 34 disposed in the idle region 36. However, instead of the idle region 36, the front edge 34C of the cam groove 34 disposed in the idle region 36 may be parallel with the insertion direction of the slider.

What is claimed is:

1. A connector for connection with a mating housing that has at least one cam pin projecting therefrom, the connector comprising:

a housing having opposite front and rear ends, the front end being configured for mating with the mating housing along a mating direction, the housing being formed with at least one accommodation space open in at least one direction transverse to the mating direction, at least one wall extending transverse to the mating direction, at least one hole being formed through the wall and communicating with the accommodation space, at least one to-be-locked portion disposed on a receiving surface in said accommodation space and aligned with the hole; and a slider having at least one cam plate movably accommodated in said accommodation space, the cam plate having at least one cam groove configured for engaging the cam pin and generating a cam action for mating the housing and the mating housing in response to moving the slider, at least one lock formed in said cam plate and being elastically deformable towards and away from the receiving surface in said accommodation space, a locking projection formed on the lock and projecting from a surface of the cam plate towards the receiving surface, said locking projection being engageable with said to-be-locked portion for holding said slider at a predetermined position.

2. The connector of claim 1, wherein the housing has at least one escape space for preventing said locking projection and said receiving surface from interfering during movement of said slider.

3. The connector of claim 1, wherein said locking projection and said to-be-locked portion are disposed and configured for selectively holding said slider at either of a wait position where said follower pin can be received at an entrance of said cam groove and a fit-in position where said housings are mated.

4. The connector of claim 3, wherein two to-be-locked portions are provided along a moving direction of said slider; and said locking projection being engageable with selected ones said to-be-locked portions for locking said cam plate selectively at one of said wait position and said fit-in position.

5. The connector of claim 1, wherein said accommodation space penetrates through said housing so that said slider can be inserted into said housing from either of two opposite sides thereof.

6. The connector of claim 1, wherein a guide is formed on said cam plate and a guide receiving portion is formed on a wall of said accommodation space said guide receiving portion matching said guide when said cam plate is inserted in a proper orientation into said accommodation space, said guide receiving portion being offset from the guide when the cam plate is oriented improperly for preventing insertion of the cam plate into said accommodation space.

7. The connector of claim 1, wherein said slider comprises a pair of cam plates and an operation portion connecting ends of said cam plates to each other.

8. The connector of claim 1, wherein the cam plate has a peripheral edge, a flexible space of the lock being spaced in from the peripheral edge of the cam plate.

9. A connector for connection with a mating housing that has at least one cam pin projecting therefrom, the connector comprising:

a housing having opposite front and rear ends, the front end being configured for mating with the mating housing along a mating direction, the housing being formed with an accommodation space open in at least one direction transverse to the mating direction, a wall extending transverse to the mating direction, at least one hole being formed through the wall in the mating direction and communicating with the accommodation space, at least one to-be-locked portion disposed on a receiving surface in said accommodation space and aligned with the hole; and a slider having a cam plate movably accommodated in said accommodation space, the cam plate having a cam groove configured for engaging the cam pin and generating a cam action for mating the housing and the mating housing in response to moving the slider, at least one lock formed in said cam plate and being elastically deformable towards and away from the receiving surface in said accommodation space, a locking projection formed on the lock and projecting towards the receiving surface, said locking projection being engageable with said to-be-locked portion for holding said slider in at least two predetermined positions.

10. The connector of claim 9, wherein the housing has at least one escape space for preventing said locking projection and said receiving surface from interfering during movement of said slider

11. The connector of claim 10, wherein said locking projection and said to-be-locked portion are disposed and configured for selectively holding said slider at either of a wait position where said follower pin can be received at an entrance of said cam groove and a fit-in position where said housings are mated.

12. The connector of claim 9, wherein the cam plate has a peripheral edge, a flexible space of the lock being spaced in from the peripheral edge of the cam plate.

13. A connector for connection with a mating housing that has at least one cam pin projecting therefrom, the connector comprising:

a housing having opposite front and rear ends, the front end being configured for mating with the mating housing along a mating direction, the housing being formed with an accommodation space open in at least one direction transverse to the mating direction, at least one to-be-locked portion disposed on a receiving surface in said accommodation space;

a slider having a cam plate movably accommodated in said accommodation space, the cam plate having a peripheral edge and a cam groove for engaging the cam pin, at least one lock formed in said cam plate, said lock being spaced inwardly from the peripheral edge so that all of said lock is surrounded by said cam plate, said lock being engageable with said to-be-locked portion for holding said slider in at least two predetermined; and a locking projection formed on the lock and proiecting towards the receiving surface, said locking proiection being engageable with said to-be-locked portion for holding said slider in at least one of two predetermined positions, the housing having at least one escape space for preventing said locking proiection and said receiving surface from interfering during movement of said slider.

14. The connector of claim 13 wherein the cam groove intersects the peripheral edge of the cam plate in a position facing the front end of the housing, said locking projection and said to-be-locked portion being disposed and configured for selectively holding said slider at either of a wait position where said follower pin can be received at an entrance of said cam groove and a fit-in position where said housings are mated.

* * * * *